United States Patent [19]

Nagatsuka et al.

[11] Patent Number: 4,904,558

[45] Date of Patent: Feb. 27, 1990

[54] MAGNETIC, TWO-COMPONENT DEVELOPER CONTAINING FLUIDITY IMPROVER AND IMAGE FORMING METHOD

[75] Inventors: Takayuki Nagatsuka; Kenji Okado; Makoto Kanbayashi, all of Yokohama, Japan

[73] Assignee: Canon Kabushiki Kaisha, Tokyo, Japan

[21] Appl. No.: 317,835

[22] Filed: Mar. 3, 1989

[30] Foreign Application Priority Data

Mar. 8, 1988 [JP] Japan ..... 63-52649
Oct. 18, 1988 [JP] Japan ..... 63-260608
Nov. 16, 1988 [JP] Japan ..... 63-287827

[51] Int. Cl.[4] ..... G03G 9/14

[52] U.S. Cl. ..... 430/122; 430/106.6; 430/110

[58] Field of Search ..... 430/122, 106.6, 110

[56] References Cited

U.S. PATENT DOCUMENTS 2,892,794 6/1959 Insalaco ..... 430/106

3,965,022 6/1976 Strong et al. ..... 430/106.6

*Primary Examiner*—J. David Welsh

*Attorney, Agent, or Firm*—Fitzpatrick, Cella, Harper & Scinto

[57] ABSTRACT

An image forming method that includes the steps of providing a developer comprising at least colored resin particles, a fluidity improver having a specific chargeability and magnetic particles wherein the colored resin particles have a volume-average particle size of 4–10 microns and a specific volume-basis particle size distribution; supplying the developer to a surface of a developer-carrying member disposed opposite to a latent image-bearing member having thereon an electrostatic latent image; carrying the developer on the surface of the developer-carrying member; and developing the electrostatic latent image on the latent image-bearing member with the developer in a developing zone where the latent image-bearing member is disposed opposite to the developer-carrying member to form a toner image; wherein an alternating electric field comprising an AC component and a DC component is imparted to the developing zone under specific conditions.

36 Claims, 7 Drawing Sheets

MAGNETIC, TWO-COMPONENT DEVELOPER CONTAINING FLUIDITY IMPROVER AND IMAGE FORMING METHOD

FIELD OF THE INVENTION AND RELATED ART

The present invention relates to a toner, a developer for developing electrostatic images and an image-forming method, which are used for developing electric latent images in image forming methods such as electrophotography and electrostatic printing.

Generally speaking, in electrophotographic processes, electrostatic latent images are formed on a photoconductive layer or a photosensitive plate comprising an inorganic photoconductive material such as selenium, zinc oxide and cadmium sulfide, or an organic photoconductive material such as anthracene and polyvinyl carbazole, dispersed in a binder resin as desired, subsequently developed by use of a developer comprising a toner to form a toner image, and the toner image is optionally transferred onto a transfer material (or transfer-receiving material) such as paper, and then fixed by heating, pressurization, heating and pressurization, or with solvent vapor to obtain copied products or prints.

In the electrophotographic process, the triboelectric charging characteristic between the toner and a toner-carrying member is important at the time of the development. If the charge amount of the toner is too small, the electrostatic attraction between the toner and the toner-carrying member is weak and therefore the toner particles are easily released from the toner-carrying member under a slight impact, whereby fog occurs in the resultant image. On the other hand, if the charge amount of the toner is too large, the toner particles are difficult to be released from the toner-carrying member even at the time of development, whereby not only the device used therefor is required to provide a strong electric field, but also the developability decreases to cause image density unevenness. Accordingly, in the production of a toner, it is necessary to provide a toner which is capable of controlling or regulating a charge amount in a suitable range.

In order to control the charge amount or chargeability of the toner, there has generally been adopted a method wherein a slight amount of a charge controller (or a charge-controlling agent) mainly comprising a dye is added to a mixture comprising a resin for fixing, and a colorant. However, it is difficult to uniformly disperse the slight amount of the charge controller in the resin, whereby there occurs a problem such that the charge amount (or chargeability) of the toner particles per se become uneven. Such a tendency is strengthened in the case of a color toner containing no low-resistivity colorant such as carbon black and magnetic material, particularly in the case of a toner having a small particle size.

On the other hand, the two-component developing system has recently been appreciated again, in view of better image density of color images. With respect to the two-component developing system, our research group has previously proposed a device therefor wherein an alternating electric field is used to obtain images of good quality having an improved image density (Japanese Laid-Open Patent Application (KOKAI) No. 32060/1980).

However, in the prior art, no attention has been paid to carrier particles constituting the two-component developer which are attached to an image portion, or to a measure to prevent such attachment (or deposition) of carrier particles. Particularly, in the case of multi-color copying, not only uniform solid images without density unevenness but also clear colors are required unlike in the case of a mono-color black image. As a result, even when the attachment of the carrier particles to the image portion is slight, poor copied images are provided.

Incidentally, in the two-component developing system using the application of an alternating electric field, the principal object has been directed to the application of the alternating electric field in order to suitably and stably attach the toner particles to the image portion and to prevent fog in the non-image (or background) portion (i.e., to prevent the toner particles from attaching to the non-image portion).

According to our investigation, because the developer comprises at least toner particles (comprising colored resin particles, and optionally various additions) and carrier particles, and the carrier particles perform an important function in the two-component developing system, the loss of the carrier particles based on the above-mentioned attachment thereof to the image portion causes a problem that a charge amount cannot be stably imparted to the toner particles, in any of the non-contact-type developing methods and the contact-type developing methods. We have recognized a problem such that the carrier particles attached to the image portion disturb the developed image per se, and particularly impair the color clearness of a multi-color image, thereby to partially deteriorate the gradational characteristic and image density.

As a result of further investigation of ours, it has been found that when inorganic oxide powder having a small particle size and excellent in fluidity-imparting ability is imparted with hydrophobicity and used as a fluidity improver, the inorganic oxide powder is excessively charged due to friction with magnetic carrier) particles because of its small particle size particularly under a low-humidity condition, and the inorganic oxide powder is firmly attached to the magnetic particles, thereby to facilitate the attachment of the magnetic particles to a latent image-bearing member. Such a tendency becomes stronger as the intensity of an electric field becomes higher, the developing speed becomes higher, the peripheral speed of a sleeve (i.e., developer-carrying member) becomes higher, or the magnetic or mechanical control of the developer at the developer application position becomes stricter. Such attachment of carrier particles is particularly problematic in the case of a multi-color image wherein transparency (i.e., freedom from turbidity) is required.

Further, as image forming apparatus such as electrophotographic copying machines have recently been used widely, their uses have also extended in various ways, and higher image quality has been demanded. For example, when original images such as photograph catalogs and maps are copied, it is demanded that even minute portions are reproduced extremely finely and faithfully without thickening or deformation, or interruption.

Particularly, in recent image forming apparatus such as electrophotographic color copying machines using digital image signals, the resultant latent picture is formed by a gathering of dots with a constant potential, and the solid, half-tone and highlight portions of the picture can be expressed by varying densities of dots. However, in a state where the dots are not faithfully covered with toner particles and the toner particles protrude from the dots, there arises a problem that a gradational characteristic of a toner image corresponding to the dot density ratio of the black portion to the white portion in the digital latent image cannot be obtained. Further, when the resolution is intended to be enhanced by decreasing the dot size so as to enhance the image quality, the reproducibility becomes poorer with respect to the latent image comprising minute dots, whereby there tends to occur an image without sharpness having a low resolution and a poor gradational characteristic (particularly, in the highlight portion).

On the other hand, in image forming apparatus such as electrophotographic copying machines, there sometimes occurs a phenomenon such that good image quality is obtained in an initial stage but deteriorates as the copying or print-out operation is successively conducted. The reason for such phenomenon may be that only toner particles which are contribute to the developing operation are consumed in advance as the copying or print-out operation is successively conducted, and toner particles having a poor developing characteristic accumulate and remain in the developing device of the image forming apparatus.

Hitherto, there have been proposed some developers for the purpose of enhancing the image quality. For example, Japanese Laid-Open Patent Application (JP-A, KOKAI) No. 3244/1976 (corresponding to U.S. Pat. Nos. 3942979, 3969251 and 4112024) has proposed a non-magnetic toner wherein the particle size distribution is regulated so as to improve the image quality. This toner predominantly comprises relatively coarse particles having a particle size of 8 - 12 microns. However, according to our investigation, it is difficult for such particle size to provide uniform and dense cover-up of the toner particles to a latent image. Further, the above-mentioned toner has a characteristic such that it contains 30% by number or less of particles of 5 microns or smaller and 5% by number or less of particles of 20 microns or larger, and therefore it has a broad particle size distribution which tends to decrease the uniformity in the resultant image. In order to form a clear image by using such relatively coarse toner particles having a broad particle size distribution, it is necessary that the gaps between the toner particles are filled by thickly superposing the toner particles thereby to enhance the apparent image density. As a result, there arises a problem that the toner consumption increases in order to obtain a prescribed image density.

Japanese Laid-Open Patent Application No. 72054/1979 (corresponding to U.S. Pat. No. 4284701) has proposed a non-magnetic toner having a sharper particle size distribution than that of the abovementioned toner. In this toner, particles having an intermediate weight have a relatively large particle size of 8.5–11.0 microns, and there is still room for improvement as a color toner for attaining a high resolution and faithfully reproducing a latent image of minute dots.

Japanese Laid-Open Patent Application No. 129437/1983 (corresponding to British Pat. No. 2114310) has proposed a non-magnetic toner wherein the average particle size is 6–10 microns and the mode particle size is 5–8 microns. However, this toner only contains particles of 5 microns or less in a small amount of 15% by number or below, and it tends to form an image without sharpness.

According to our investigation, it has been found that toner particles having a particle size of 5 microns or smaller have a primary function of clearly reproducing the minute dots of a latent image and of attaining close and precise cover-up of the toner to the entire latent image portion.

Particularly, in the case of an electrostatic latent image formed on a photosensitive member, the field intensity in the edge portion of the minute dots is higher than that in the inner portion thereof because of the concentration of the electric lines of force, whereby the sharpness of the resultant image is determined by the quality of toner particles collected to this portion. According to our investigation, it has been found that the control of quantity and distribution state for toner particles of 5 microns or smaller is effective in solving the problem in the gradational characteristic in a highlight portion.

However, as the particle size of toner particles is decreased to increase the amount of those having a particle size of 5 microns or smaller, the agglomerative property of the toner particles becomes stronger thereby to cause a problem such that their mixability with carrier particles decreases or their fluidity decreases.

In order to improve the fluidity of a toner, it has heretofore been attempted to add a fluidity improver thereto. According to our investigation however, it has been found difficult to satisfy the prevention of toner scattering and high image density while retaining good balance between the fluidity and charging characteristic of the toner, in a case where the particle size distribution, particularly coarse powder content, is not considered.

SUMMARY OF THE INVENTION

An object of the present invention is to provide a developer which has a stable triboelectric chargeability, and particularly is excellent in prevention of the attachment of magnetic (or carrier) particles, and an image forming method using the developer.

Another object of the present invention is to provide a color developer which is excellent in color mixing characteristic and particularly in light-transmissivity when used for an overhead projector (OHP) transparency, and an image forming method using the developer.

A further object of the present invention is to provide a color developer which provides little scattering of toner particles, and an image forming method using the developer.

A further object of the present invention is to provide a developer capable of providing highquality images having good color-reproducibility.

A further object of the present invention is to provide a developer which shows little change in performances even when environmental conditions change.

A further object of the present invention is to provide a developer capable of retaining good developing characteristics under low temperature-low humidity conditions and retaining suitable developing characteristics under high temperature-high humidity conditions.

A further object of the present invention is to provide a toner and a developer having excellent fluidity.

A further object of the present invention is to provide a color toner which has an excellent thin-line reproducibility and gradational characteristic in a highlight portion and is capable of providing a high image density.

A further object of the present invention is to provide a color toner which shows little change in performances when used in a long period.

A further object of the present invention is to provide a color toner which shows little change in performances even when environmental conditions change.

A further object of the present invention is to provide a color toner which shows an excellent transferability.

A further object of the present invention is to provide a color toner which is capable of providing a high image density by using a small consumption thereof.

A still further object of the present invention is to provide a color toner which is capable of forming a toner image excellent in resolution, gradational characteristic in a highlight portion, and thin-line reproducibility even when used in an image forming apparatus using a digital image signal.

According to the present invention, there is provided an image forming method, comprising:

providing a developer comprising at least colored resin particles, a fluidity improver and magnetic particles wherein the colored resin particles have a volume-average particle size of 4–10 microns and a volume-basis particle size distribution such that they contain 1% by volume or below of particles having a particle size of 20.2 microns or larger, and the fluidity improver has a triboelectric charging characteristic such that it provides an absolute value of triboelectric charge amount of 100 $\mu c/g$ or smaller with respect to the magnetic particles;

supplying the developer to a surface of a developer-carrying member disposed opposite to a latent image-bearing member having thereon an electrostatic latent image;

carrying the developer on the surface of the developer-carrying member; and developing the electrostatic latent image on the latent image-bearing member with the developer in a developing zone where the latent image-bearing member is disposed opposite to the developer-carrying member to form a toner image;

wherein an alternating electric field comprising an AC Component and a DC Component is imparted to the developing zone; the maximum electric field strength F (V/micron) formed in the minimum clearance G (micron) between the surface of the developer-carrying member and the surface of the electrostatic latent image-bearing member satisfies the following relationships:

$$1.5 \leqq F \leqq 3.5, \text{ and}$$

$$F = |VppMax/2| + |V_{DC} - V_L|/G,$$

wherein $V_L$ (V) denotes the potential of the electrostatic image portion (i.e., portion supplied with image exposure), $V_{DC}$(V) denotes the voltage of the DC component of the alternating electric field having the same polarity as that of $V_L$, and VppMax (V) denotes the voltage at the maximum electric field application point which is at the opposite side of the image portion potential $V_L$ with respect to the $V_{DC}$; the frequency $\nu$ (KHz) of the alternating electric field satisfies $0.8 \leqq \nu \leqq 3.0$; the relative volumetric ratio Q (%) of the magnetic particles satisfies $15.0 \leqq Q \leqq 45.0$; and the ratio $\sigma$ between the peripheral speed of the developer-carrying member and that of the electrostatic image-bearing member in the developing zone satisfies $1.2 \leqq \sigma \leqq 2.5$.

The present invention also provides a developer for developing electrostatic latent images, comprising at least magnetic particles, colored resin particles and a fluidity improver; the magnetic particles having a weight-average particle size of 35–65 microns, and a weight-basis distribution such that they contain 1–20 wt. % of magnetic particles having a particle size of not less than 26 microns and below 35 microns, 5–20 wt. % of magnetic particles having a particle size of 35–43 microns, and 2 wt. % or less of magnetic particles having a particle size of 74 microns or above; the colored resin particles having a volume-average particle size of 4–10 microns and a volume-basis distribution such that they contain 1% or less of particles having a particle size of 20.2 microns or above; the fluidity improver having a charging characteristic satisfying the following conditions:

$$0.5 \leqq |B/A| \leqq 2, \text{ and}$$

$$15 \leqq |A| \leqq 100,$$

wherein A denotes the triboelectric charge amount of the fluidity improver when mixed with the magnetic particles reciprocally 60 times, and B denotes that of the fluidity improver when mixed with the magnetic particles reciprocally 30,000 times.

The present invention further provides a toner for developing electrostatic latent images comprising: colored resin particles having a volume-average particle size of 4–10 microns, a wt. % (based on the colored resin particles) of a hydrophobic inorganic oxide A, and b wt. % (based on the colored resin particles) of a hydrophilic inorganic compound B; the hydrophobic inorganic oxide A having an absolute value of triboelectric charge amount of 50 $\mu C/g$ or larger and a BET specific surface area ($S_A$) of 80–300 $m^2/g$; the hydrophilic inorganic compound (preferably, a hydrophilic inorganic oxide) B having an absolute value of triboelectric charge amount of 20 $\mu c/g$ or below, and a BET specific surface area ($S_B$) of 30–200 $m^2/g$; the specific surface areas $S_A$ and $S_B$, and the contents a and b satisfying the following conditions:

$$SA \geqq S_B,$$

$$a \geqq b, \text{ and}$$

$$0.3 \leqq (a+b) \leqq 1.5.$$

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
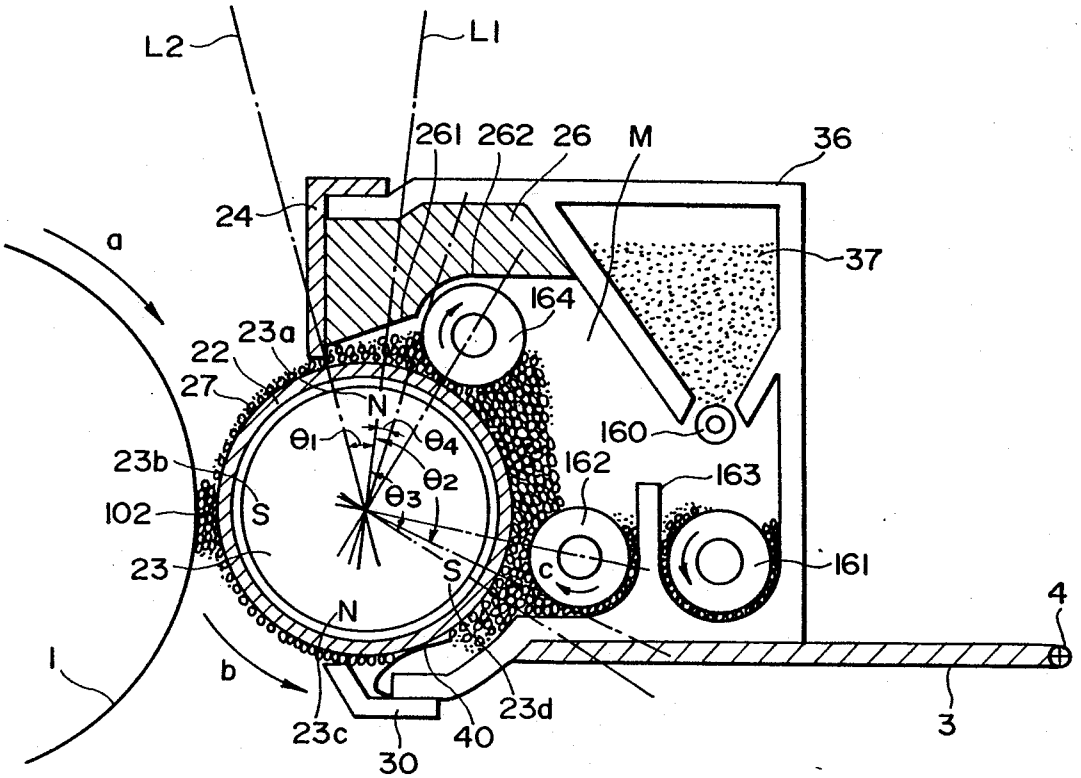
FIG. 1 is a schematic sectional view showing an important part of a developing means preferably used in the present invention.

The developer according to the present invention comprises, at least, magnetic particles, colored resinous particles and a fluidity improver. Hereinbelow, respective materials constituting the developer will be described.

First, magnetic particles are specifically described.

The magnetic particles (carrier) used in the present invention may be composed of, e.g., iron or an alloy of iron with nickel, copper, zinc, cobalt, manganese, chromium, and rare earth elements in the surface oxidized form or in the surface non-oxidized form, or of an oxide or ferrite form of these metal or alloys.

In the present invention, it is preferred to coat the surface of the magnetic particles with a resin. The magnetic particles may preferably be coated with a resin by dipping the carrier in a solution or suspension of a coating material of a resin in view of the stability of the resultant coating layer. The coating material on the magnetic particle surface may vary depending on the material for the colored resin particle or toner.

Preferred examples of the resin used for positively charging the colored resin particle or toner particle may for example include aminoacrylate resins, acrylic resins, or copolymer resins comprising a styrene-type monomer and a monomer constituting the above-mentioned resins, because these resins are on the positive side in the electrification series. On the other hand, preferred examples of the resin used for negatively charging the colored resin particle or toner particle may include: silicone resins, polyester resins, polytetrafluoroethylene, monochlorotrifluoroethylene polymers, and polyvinylidene fluoride, because these resins are on the negative side in the electrification series.

Particularly preferred magnetic particles used in the present invention are those comprising 98 wt. % or more of ferrite particles having a composition of Cu-Zn-Fe (Composition wt. ratio of (5–20):(5–20):(30–80)). Such magnetic particles are preferred because their surfaces may easily be smoothed, their charge-imparting ability is stable and they may be stably coated. The coating material used in combination with the above-mentioned ferrite particles may preferably be an acrylic resin or a styrene-acrylic monomer copolymer resin, as that on the positive side; and may preferably be a silicone resin, a vinylidene fluoride-tetrafluoroethylene copolymer, as that on the negative side.

The amount of the coating of the above-mentioned compound may appropriately be determined so that the resultant magnetic particles may satisfy the above-mentioned conditions with respect to the triboelectric charging characteristic with the colored resin particles and fluidity improver, and to electric resistivity. The amount of the coating material may generally be 0.1–30 wt. %, preferably 0.3–20 wt. %, in total, based on the weight of the magnetic particles used in the present invention. The magnetic particles coated with a resin may preferably have an electric resistivity of $10^7$ ohm.cm or more, more preferably $10^8$ ohm.cm or more, particularly preferably $10^9$–$10^{12}$ ohm.cm or more.

The weight-average particle size of the magnetic particles may preferably be 35–65 microns, more preferably 40–60 microns. In order to retain good image quality, it is further preferred that in a weight-basis distribution the wt. proportion of particles having a particle size of 25 microns or above and below 35 microns is 1–20 wt. %, the proportion of those having a particle size of 35–43 microns is 5–20%, and the proportion of those having a particle size of 74 microns or larger is 2% or below.

In the present invention, sharply meltable colored resin particles may preferably be used in order to obtain good multi-color images. On the other hand, such colored resin particles are liable to stick to a latent image-bearing member.

When colored resin particles stick to the latent image-bearing member, charges are accumulated on the latent image-bearing member and $|V_{DC}-V_D|$ ($V_{DC}$: developing bias potential, $V_D$: dark part potential of a latent image) becomes higher than 200 V. When $|V_{DC}-V_D|$ exceeds 200 V, magnetic particles of 35 microns or smaller are attached to the latent image-bearing member and show an effect of abrading the stickings on the latent image-bearing member thereby to obviate an image defect.

In such a case, when the proportion of magnetic particles of 35 microns or smaller exceeds 20% in the weight-basis distribution, they are also attached to a portion wherein $|V_{DC}-V_D|$ is smaller than 200 V, whereby problems such as image defect and wear of a drum (i.e., latent image-bearing member) are liable to occur. On the other hand, when the proportion of magnetic particles of 26 microns or above and below 35 microns is below 1% in the weight-basis distribution, the abrasion effect of the magnetic particle is liable to be insufficient, and the function thereof of abrading the stickings to obviate the image defect is liable to be insufficient.

In the developer according to the present invention, the proportion of magnetic particles of 26 microns or above and below 35 microns is 1–20%. Such a proportion is more effective when the volume-average particle size of the color resin particles is 4–10 microns. The reason for this is that the above-mentioned magnetic particles remove the colored resin particles sticking onto a latent image-bearing member, while such resin particles have a strong adhesion to the latent image-bearing member and are more liable to stick thereto.

Next, there is described a toner comprising colored resin particles and an agent externally added thereto. The colored resin particle comprises a binder resin and a colorant, and optionally a charge control agent and another additive.

Examples of the binder resin constituting the colored resin particle according to the present invention may include: homopolymers or copolymers or styrene and its derivatives such as polystyrene, poly-p-chlorostyrene, polyvinyltoluene, styrene-p-chlorostyrene copolymer, styrene-vinyltoluene copolymer; copolymers of styrene and acrylic acid esters such as styrene-methyl acrylate copolymer, styrene-ethyl acrylate copolymer, styrene-n-butyl acrylate copolymer; copolymers of styrene and methacrylic acid esters such as styrene-methyl methacrylate copolymer, styrene-ethyl methacrylate copolymer, styrene-n-butyl methacrylate copolymer; multi-component copolymers of styrene, acrylic acid esters and methacrylic acid esters; copolymers of styrene and other vinyl monomers such as styrene-acrylonitrile copolymer, styrene-vinyl methyl ether copolymer, styrene-butadiene copolymer, styrene-vinyl methyl ketone copolymer, styrene-acrylonitrileindene copolymer, styrene-maleic acid ester copolymer; polymethyl methacrylate, polybutyl methacrylate, polyvinyl acetate, polyesters, polyamides, epoxy resins, polyvinyl butyral, polyacrylic acid resin, phenolic resins, aliphatic or alicyclic hydrocarbon resins, petroleum resin, chlorinated paraffin, etc. These binder resins may be used either singly or as a mixture.

Preferred examples of the binder resin suitably used or a toner for a pressure fixing system may include: low-molecular weight polyethylene, low-molecular weight polypropylene, ethylene-vinyl acetate copolymer, ethylene-acrylic acid ester copolymer, higher fatty acid, polyamide resin and polyester resin. These binder resins may be used either singly or as a mixture of two or more species.

Particularly preferred example of the binder resin may include a styrene-acrylic acid ester copolymer and a polyester resin.

In view of sharp melting characteristics, particularly preferred resins may be polyester resins obtained through polycondensation of at least a diol component selected from bisphenol derivatives represented by the formula:

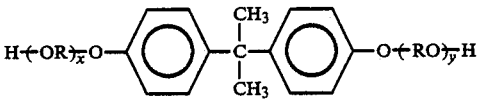

wherein R denotes an ethylene or propylene group; x and y are respectively a positive integer of 1 or more providing the sum (x+y) of 2 to 10 on an average and their substitution derivatives, and a two- or more-functioned carboxylic acid component or its anhydride or its lower alkyl ester, such as fumaric acid, maleic acid, maleic anhydride, phthalic acid, terephthalic acid, trimellitic acid, pyromellitic acid.

Particularly, in view of the light-transmissivity of a transparency for OHP having thereon a fixed toner image, the toner according to the present invention may preferably have an apparent viscosity at 90° C. of $5\times10^4$ to $5\times10^5$ poise, preferably $2.5\times10^4$ to $2\times10^6$ poise, more preferably $10^5$ to $10^6$ poise, and an apparent viscosity at 100° C. of $10^4$ to $5\times10^5$ poise, preferably $10^4$ to $3.0\times10^5$ poise, more preferably $10^4$ to $2\times10^5$ poise.

When the toner satisfies the above-mentioned condition, it provides a transparency for OHP which has thereon a color image and has a very good light-transmissivity, and provides good results as a full-color toner with respect to fixability, color-mixing characteristic and resistance to high-temperature offset.

It is particularly preferred that the toner has an apparent viscosity at 90° C. of $P_1$ and an apparent viscosity at 100° C. of $P_2$ satisfying the relation of $2\times10^5 < |P_2-P_1| < 4\times10^6$.

As the colorant, a dye or pigment may be used. Specific examples thereof include: Phthalocyanine Blue, Indanthrene Blue, Peacock Blue, Permanent Red, Lake Red, Rhodamine Lake, Hansa Yellow, Permanent Yellow, and Benzidine Yellow.

As for the content of the colorants, which sensitively affects the transparency of an OHP film, may preferably be used in a proportion of 0.1 to 12 wt. parts, more preferably 0.5–9 wt. parts, per 100 wt. parts of the binder resin.

The colored resin particles used in the present invention, may preferably have a particle size distribution such that they have a volume-average particle size of 6–10 microns; contain 15–40% by number of colored resin particles having a particle size of 5 microns or smaller; contain 0.1–5.0 by volume of colored resin particles having a particle size of 12.7–16.0 microns; and contain 1.0% by volume or less of colored toner particles having a particle size of 16 microns or larger; and the colored resin particles having a particle size of 6.35–10.1 microns have a particle size distribution satisfying the following formula:

$$9 \leqq (V\times\overline{dv})/N \leqq 14,$$

wherein N denotes the percentage by number of colored resin particles having a particle size of 6.35–10.1 microns, V denotes the percentage by volume of colored resin particles having a particle size of 6.35–10.1 microns, and $\overline{dv}$ denotes the volume-average particle size of the entire colored resin particles.

The toner comprising the above-mentioned colored resin particles and an external additive may preferably have an agglomeration degree of 25% or below and an apparent density of 0.2 to 0.8 g/cm$^3$, an apparent viscosity at 100° C. of $10^4$ to $5\times10^5$ poise, an apparent viscosity at 90° C. of $5\times10^4$ to $5\times10^6$ poise, and a DSC heat-absorption peak at 58° to 72° C.

Incidentally, the particle size distribution of the colored resin particles per se and that of the toner (i.e., the colored resin particles to which minute fluidity improver has been added by external addition) are substantially the same.

The colored resin particle having the above-mentioned particle size distribution can faithfully reproduce a latent image formed on a photosensitive member, and are excellent in reproduction of dot latent images such as halftone dot and digital images, whereby they provide images excellent in gradation and resolution characteristics, particularly in a highlight portion. Further, the toner according to the present invention can retain a high image quality even in the case of successive copying or print-out, and can effect good development by using a smaller consumption thereof as compared with the conventional non-magnetic toner, even in the case of high-density images. As a result, the toner of the present invention is excellent in economical characteristics and further has an advantage in miniaturization of the main body of a copying machine or printer.

The reason for the above-mentioned effects of the colored resin particles according to the present invention is not necessarily clear but may assumably be considered as follows.

The colored resin particles according to the present invention are first characterized in that they contain 15–40% by number of particles of 5 microns or below. Conventionally, it has been considered that colored resin particles of 5 microns or below are required to be positively reduced because the control of their charge amount is difficult, they impair the fluidity of the toner, and they cause toner scattering to contaminate the machine.

However, according to our investigation, it has been found that the colored resin particles of 5 microns or below are an essential component to form a high-quality image.

For example, we have conducted the following experiment by using a two-component developer comprising a carrier and a toner which comprises a fluidity and colored toner particles.

Thus, there was formed on a photosensitive member a latent image wherein the latent image potential on the photosensitive member was changed from a large developing potential contrast at which the latent image would easily be developed with a large number of colored resin particles, to a halftone developing potential, and further to a latent image comprising minute dots at which the latent image would be developed with only a small number of colored resin particles.

Such a latent image was developed with a two-component developer comprising carrier and a toner which comprises a fluidity and colored resin particles toner having a particle size distribution ranging from 0.5 to 30 microns. Then, the colored resin particles attached to the photosensitive member were collected and the particle size distribution thereof was measured. As a result, it was found that on the latent image comprising minute dots, there were many colored resin particles having a particle size of 8 microns or below, particularly about 5 microns. Based on such finding, it was discovered that when colored resin particles of about 5 microns were so controlled that they were smoothly supplied for the development of a latent image formed on a photosensitive member, there could be obtained an image truly excellent in reproducibility, and the colored resin particles were faithfully attached to the latent image without protruding therefrom.

It is preferred that the colored resin particles according to the present invention contain 0.1–5.0% by volume of particles of 12.7–16.0 microns. Such a characteristic relates to the above-mentioned necessity for the presence of the colored resin particles or non-magnetic toner particles of 5 microns or below.

As described above, the particles having a particle size of 5 microns or below have the ability to faithfully reproduce a latent image comprising minute dots. However, because such particles per se have a considerably agglomerative property, they sometimes impair the fluidity as colored resin particles or toner particles.

In order to improve the fluidity, we have attempted to add a fluidity improver as described hereinafter (preferably, a mixture of two or more species of inorganic oxides) to the above-mentioned toner. However, it was found that there was only a little latitude in conditions satisfying respective items of image density, toner scattering, and fog when an inorganic oxide was simply added.

As a result of further investigation on the particle size distribution of toners, we have found that the problem of fluidity is solved and high image quality is attained by causing a toner to contain 15–40% by number of non-magnetic toner particles of 5 microns or below and to contain 0.1–5.0% by volume of toner particles of 12.7–16.0 microns.

According to our knowledge, the reason for such phenomenon may be considered that the colored resin particle of 12.7–16.0 microns have a suitably controlled fluidity in relation to those of 5 microns or below. As a result, there may be provided a sharp image having a high-image density and excellent resolution and gradation characteristic, even in successive copying or print-out.

In the toner according to the present invention, it is preferred that having a particle size of 6.35–10.1 microns satisfy the following relation between their percentage by number (N), percentage by volume (V), and volume-average particle size ($\overline{dv}$):

$$9 \leqq (V \times dv)/N \leqq 14,$$

wherein $$6 \leqq dv \leqq 10.$$

According to our investigation on the state of the particle size distribution and developing characteristics we have found that there is a suitable state of the presence of the particle size distribution. More specifically, in a case where the particle size distribution is regulated by general wind-force classification, it may be understood that a large value of ($V \times \overline{dv}/N$) indicates that the proportion of colored resin particles of about 5 microns capable of faithfully reproducing a latent image of minute dots is large, and a small value of ($V \times \overline{dv}/N$) indicates that the proportion of particles of about 5 microns is small. When $\overline{dv}$ is in the range of 6–10 microns, and the relation represented by the above-mentioned formula is satisfied, good fluidity of the toner and good reproducibility with respect to latent images are attained.

In the present invention, colored resin particles having a particle size of 16 microns or larger are contained in an amount of 1.0% by volume or below. The amount of these particles may preferably be as small as possible.

Hereinbelow, the present invention will be described in more detail.

In the present invention, the colored resin particles having a particle size of 5 microns or smaller may preferably be contained in an amount of 15–40% by number, more preferably 20–35% by number, based on the total number of particles. If the amount of colored resin particles of 5 microns or smaller is smaller than 15% by number, the particles effective in enhancing image quality is insufficient. Particularly, as the toner particles are consumed in successive copying or print-out, the component of effective colored resin particles is decreased, and the balance in the particle size distribution of the toner shown by the present invention is deteriorated, whereby the image quality gradually decreases. On the other hand, if the above-mentioned amount exceeds 40% by number, the toner particles are liable to be mutually agglomerated to produce toner agglomerates having a size larger than the original particle size. As a result, roughened images are provided, the resolution is lowered, and the density difference between the edge and inner portions is increased, whereby an image having an inner portion with a little low density is liable to occur.

In the toner of the present invention, the amount of particles in the range of 12.7–16.0 microns may preferably be 0.1–5.0% by volume, more preferably 0.2–3.0% by volume. If the above-mentioned amount is larger than 5.0% by volume, not only the image quality deteriorates but also excess development (i.e., excess cover-up of toner particles) occurs, thereby to invite an increase in toner consumption. On the other hand, if the above-mentioned amount is smaller than 0.1% by volume, the resultant high image density is lowered because of a decrease in fluidity.

In the toner of the present invention, the amount of colored resin particles having a particle size of 16 microns or larger may preferably be 1.0% by volume or smaller, more preferably 0.6% by volume or smaller.

If the above amount is larger than 1.0% by volume, these particles impair thin-line reproducibility. In addition, toner particles of 16 microns or larger are present as protrusions on the surface of the thin layer of toner particles formed on a photosensitive member by development, and they vary the transfer condition for the toner by irregulating the delicate contact state between the photosensitive member and a transfer paper (or a transfer-receiving paper) by the medium of the toner layer. As a result, there occurs an image with transfer failure.

In the present invention, the volume-average particle size of the colored resin particles is 6–10 microns, preferably 7–9 microns. This value closely relates to the above-mentioned characteristics of the toner according to the present invention. If the volume-average particle size is smaller than 6 microns, there tend to occur problems such that the amount of toner particles transferred to a transfer paper is insufficient and the image density is low, in the case of an image such as graphic image wherein the ratio of the image portion area to the whole area is high. The reason for such phenomenon may be considered the same as in the above-mentioned case wherein the inner portion of a latent image provides a lower image density than that in the edge portion thereof. If the volume-average particle size exceeds 10 microns, the resultant resolution is not good and there tends to occur a phenomenon such that the image quality is lowered in copying even when it is good in the initial stage thereof.

The particle distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned coulter counter Model TA-II with a 100 micron-aperture to obtain a volume-basis distribution and a number-basis distribution. Form the results of the volume-basis distribution and number-basis distribution, parameters characterizing the toner of the present invention may be obtained.

Next, the fluidity improver or fluidity-improving agent used in the present invention is specifically described.

The toner and developer according to the present invention contains a fluidity improver (preferably, in the form of powder) capable of providing an absolute value of charge amount of 100 μc/g or smaller, preferably 30 μc/g or smaller, more preferably 10 μc/g or smaller, when triboelectrically charged by using magnetic particles used in the present invention. In the present invention, it is further preferred to use two or more species of fluidity improvers.

In such an embodiment, a first fluidity improver usable in the present invention is one providing an absolute value of charge amount of 30 μc/g or smaller. In order to impart fluidity, a fluidity improver having a smaller particle size is more effective in enhancing the fluidity. In the present invention, it is preferred to use a fluidity improver having a BET specific surface area of 30 $m^2/g$ or larger.

A second fluidity improver usable in the present invention may preferably be one satisfying the following relationships:

$$0.5 \leqq |B/A| \leqq, \text{ and}$$

$$15 \leqq |A| \leqq 100,$$

Wherein A (μc/g) denotes a triboelectric charge amount imparted to the fluidity improver when it is mixed with magnetic particles by reciprocally shaking them 60 times, and B (μc/g) denotes a triboelectric charge amount imparted to the fluidity improver when it is mixed with magnetic particles by reciprocally shaking them 30,000 times.

Hereinbelow, there is described an embodiment of the present invention wherein a hydrophilic inorganic compound B is used as the first fluidity improver, and a hydrophobic inorganic oxide A is used as the second fluidity improver. Incidentally, in the description appearing hereinafter, a powder mixture comprising colored resin particles and a fluidity improver is sometimes referred to "toner".

In a further preferred embodiment of the present invention, the specific surface area ($S_A$) of the hydrophobic inorganic compound A and the specific surface area ($S_B$) of the hydrophilic inorganic oxide B satisfy the following relationship:

$$SA \leqq S_B,$$

and the content (a wt. %) of the hydrophobic inorganic compound A and the content (b wt. %) of the hydrophilic inorganic oxide B, both based on the weight of colored resin particles, satisfy the following relationship:

$$a \leqq b, \text{ and}$$

$$0.3 \leqq (a+b) \leqq 1.5.$$

If $a<b$, or the sum $(a+b)$ is outside the above-mentioned range, it is difficult to obtain good balance between the chargeability and fluidity. Further, if $(a+b)>1.5$, the fixing characteristic of the toner is lowered, and particularly the transmissivity of a transparency having thereon a fixed toner image is lowered.

The hydrophobic inorganic oxide used in the present invention may preferably be a negatively chargeable inorganic oxide having a specific surface area of 80 $m^2/g$ or larger, and an absolute value of charge amount of 50 μc/g or larger when triboelectrically charged by using magnetic particles.

Preferred examples of such an inorganic oxide include hydrophobic silica fine powder obtained by subjecting the dry-process silica fine powder (obtained by vapor phase oxidation of silicon halide) to a hydrophobicity-imparting treatment. Such hydrophobic silica fine powder having a hydrophobicity of 30–80 as measured by methanol titration is particularly preferred.

A hydrophobicity-imparting treatment may be effected by treating the silica fine powder with an organosilicon compound capable of reacting with or being physically adsorbed on the silica fine powder. It is further preferred to treat silica fine powder obtained by vapor phase oxidation of silicon halide, with an organic silicon compound.

Examples of the organosilicon compound include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, and further dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units per molecule and containing each one hydroxyl group bonded to Si at the terminal units and the like. These may be used alone or as a mixture of two or more compounds.

The hydrophobic silica fine powder may preferably have a particle size in the range of 0.003 to 0.1 micron. Examples of the commercially available products may include Tullanox-500 (available from Tulco Inc.), and AEROSIL R-872 (Nihon Aerosil K.K.).

On the other hand, preferred examples of the hydrophilic inorganic compound B include: metal oxides such as $Al_2O_3$, $TiO_2$, $GeO_2$, $ZrO_2$, $Sc_2O_3$ and $HfO_2$; carbides such as SiC, TiC and $W_2C$; and nitrides such as $Si_3N_4$ and $Ge_3N_4$. These compounds are preferred because of their low chargeability. Among these, $Al_2O_3$, $TiO_2$, $Sc_2O_3$, $ZrO_2$, $GeO_2$ and $HfO_2$ are preferred because they are colorless or white, and therefore do not affect a color when used for a color toner. As the hydrophilic inorganic compound B, an inorganic oxide such as $Al_2O_3$ and $TiO_2$ is further preferred because they may easily provide a suitable particle size when produced by a vapor phase method. However, those having an extremely angular shape or a needle shape are not preferred.

Hereinbelow, there is described an embodiment wherein the first fluidity improver comprises alumina or titanium powder and the second fluidity improver comprises hydrophobic silica powder. A powder mixture comprising colored resin particles and a fluidity improver is sometimes referred to "toner".

In a developer comprising non-magnetic colored resin particles, a fluidity improver and magnetic particles, it is preferred that the colored resin particles have a negative chargeability and a volume-average particle size of 4–10 microns, and the fluidity improver comprises alumina and/or titanium oxide each having a BET specific surface area of 30–200 $m^2/g$ and hydrophobic silica having a BET specific surface area 80 $m^2/g$ or larger.

The colored resin particles used in the present invention preferably have a volume-average particle size of 4–10 microns, contain 1.0% by volume or less of coarse particles of 16.0 microns or smaller and 35% by number or less of fine particles of 5.04 microns or smaller. Because such a toner has a small particle size, it may faithfully be attached to a minute latent image and its attachment in the edge portion of the latent image is little disturbed, whereby good images having high resolution and good color reproducibility are provided. Particularly, because the halftone portion of a latent image to be formed in a digital-type copying machine comprises minute dots, the effect of the above-mentioned particle size is considerable, whereby good images are provided.

While a toner having a small particle size is liable to be excessively charged, such problem has been solved by adding alumina or titanium oxide, i.e., a substance having a low chargeability, to the toner in the present invention.

In such an embodiment, these materials have a BET specific surface area of 30 $m^2/g$ (corresponding to a particle size of about 40 millimicron (mμ) to 200 $m^2/g$ (about 12 mμ), preferably 80 $m^2/g$ (about 25 mμ) to 150 $m^2/g$ (about 15 mμ). The reason for this is as follows:

For example, alumina or titanium oxide having a BET specific surface area of above 200 $m^2/g$ may provide sufficient fluidity, but it only provides a toner which is liable t deteriorate. Such deterioration appears as a phenomenon such that the amount of charge considerably changes or the fluidity of the toner becomes poor, when copying with a small toner consumption is successively conducted.

On the other hand, when alumina or titanium oxide having a BET specific surface area of below 30 $m^2/g$ is used, it is difficult to provide sufficient fluidity, even in combination with another fluidity improver. Further, such alumina or titanium oxide is liable to provide fog in the resultant image.

When the BET specific surface area of the alumina or titanium oxide is represented by $S_B$, in the range of $30 \leqq S_B \leqq 100$ $m^2/g$, the use of the alumina or titanium oxide above provides insufficient fluidity. Accordingly, it is necessary to use hydrophobic silica having much fluidity-imparting effect, in combination therewith. Further, in the range of $100 \leqq S_B \leqq 200$ $m^2/g$, because the alumina or titanium oxide coats the surfaces of colored resin particles uniformly and densely, the amount of charge becomes too small when the alumina or titanium oxide having a low chargeability is used alone. Accordingly, it is necessary to use negatively chargeable hydrophobic silica in combination therewith.

As described above, with respect to negative chargeability and fluidity-imparting ability the hydrophobic silica has a function of supplementing the alumina or titanium oxide. Accordingly, the hydrophobic silica does not have a sufficient function unless it has a BET specific surface area of 80 $m^2/g$ or larger, more preferably 150 $m^2/g$ or larger.

In the present invention, not only the above-mentioned control of the charge amount is improved but also another problem caused by the reduction in particle size of a toner is solved by the combination of the alumina or titanium oxide, and hydrophobic silica.

When the particle size of a toner is reduced, Coulomb force or Van der Waals force exerted on the toner particle become relatively strong as compared with gravity or inertia force, whereby the adhesion or cohesion between the toner particles becomes strong and agglomerates of the toner particles are liable to occur. On the other hand, the above-mentioned alumina or titanium oxide weakens the adhesion of the toner based on its electrification, and prevents the toner particles from forming their agglomerates. When the particle size of the toner is reduced, contact points between the toner particles and carrier particles are increased, whereby the toner particles (or components constituting them) are liable to stick to the carrier particles. With respect to such a phenomenon, the alumina or titanium oxide functions as a spacer between the carrier particles and the toner particles, thereby to produce a good effect.

Further, when the above-mentioned alumina, titanium oxide and hydrophobic silica are used in combination, the fluidity of the toner is improved as compared with the case where each material is used alone, whereby mixability in the developer and cleaning characteristic of the toner are improved.

In the present invention, it is possible to add charge control agent to the colored resin particles in order to stabilize the chargeability. In such an embodiment, it is preferred to use a colorless or thin-colored charge control agent so as not to affect the color tone of the colored resin particle. In the present invention, a negative charge control agent is more effective. The negative charge control agent may for example be an organometal complex such as a metal complex of alkyl-substituted salicylic acid (e.g., chromium complex or zinc complex of di-tertiary-butylsalicylic acid). The negative charge control agent may be added to colored resin particles in a proportion of 0.1 to 10 wt. parts, preferably 0.5 to 8 wt. parts, per 100 wt. parts of the binder resin.

A two-component developer may be prepared by mixing color toner particles (or colored resin particles) according to the present invention with magnetic particles (carrier) so as to give a toner concentration in the developer of 2.0 wt. % - 12 wt. %, preferably 3 wt. % to 9 wt. %, which generally provides good results. A toner concentration of below 2.0 wt. % results in a low image density of the obtained toner image, and a toner concentration of above 12 wt. % is liable to result in increased fog and scattering of toner in the apparatus and a decrease in life of the developer.

Next, there is described an embodiment of the developing device according to the present invention with reference to FIG. 1.

Referring to FIG. 1, a latent image-bearing member 1 is an insulating drum for electrostatic recording or a photosensitive drum or belt comprising a layer of a photoconductive material such as α-Se, CdS, $SnO_2$, OPC (organic photoconductor) and α-Si. The latent image bearing member 1 is driven in the direction indicated by an arrow a by a driving device (not shown). The developing device includes a developing sleeve 22 which is opposed or caused to contact the image bearing member 1 and is made of non-magnetic material such as aluminum, SUS 316 (stainless steel, JIS). The developing sleeve 22 is in a longitudinal opening formed in a lower left wall of a developer container 36, and about a right half peripheral surface is in the container 36, whereas about a left half peripheral surface thereof is exposed outside. The developing sleeve 22 is rotatably supported and is driven in the direction indicated by an arrow b.

The developing device further includes a stationary magnetic field generating means 23 in the form of a stationary permanent magnet within the developing sleeve 22. The permanent magnet 23 is fixed and is maintained stationary even when the developing sleeve 22 is rotated. The magnet 23 has an N-pole 23*a*, S-pole 23*b*, N-pole 23*c* and an S-pole 23*d*, that is, it has four poles. The magnet 23 may be an electromagnetic in place of the permanent magnet. A non-magnetic blade 24 has a base portion fixed to a side wall of the container adjacent a top edge of the opening in which the developing sleeve 22 is disposed, and a free end extending at a top edge of the opening. The blade 24 serves to regulate the developer carried on the developing sleeve 22. The non-magnetic blade is made by, for example, bending to "L" shape a stainless steel plate (SUS316).

The developing device includes a magnetic carrier particle limiting member 26 which is disposed so that the upper surface thereof contacts the lower surface of the non-magnetic blade 24. The bottom surface 261 of the limiting member 26 constitutes a developer guiding surface. The non-magnetic blade 24, the magnetic particle limiting member 26, etc., define a developer regulating station.

The reference numeral 27 designates magnetic carrier particles having a resistivity of not less than $10^7$ ohm.cm, preferably not less than $10^8$ ohm.cm, more preferably $10^9$–$10^{12}$ ohm.cm. As an example of such carrier particles, ferrite particles (maximum magnetization 55–75 emu/g) are coated with a resin.

The reference numeral 37 designates non-magnetic toner.

A sealing member 40 is effective to prevent the toner stagnating adjacent the bottom of the developer container 36 from leaking. The sealing member 40 is bent co-directionally with the rotation of the sleeve 22, and is resiliently pressed onto the surface of the sleeve 22. The sealing member 40 has its end portion at a downstream side in the region where it is contacted to the sleeve 22 so as to allow the developer returning into the container.

An electrode plate 30 for preventing scattering of the floating toner particles produced by the developing process, is supplied with a voltage having a polarity which is the same as the polarity of the toner to cause the toner particles to be deposited on the photosensitive member.

A toner supplying roller 160 is operative in response to an output of an toner content detecting sensor (not shown). The sensor maybe, for example, of a developer volume detecting type, a piezoelectric element type, an inductance change detecting type, an antenna type utilizing an alternating bias, or an optical density detecting type. By the rotation of the roller 160, the non-magnetic toner 37 is supplied. The supplied toner 37 is mixed and stirred while being conveyed by the screw 161 in the longitudinal direction of the sleeve 22. During the conveyance, the toner supplied is triboelectrically charged by the friction with the carrier particles. A partition 163 is cutaway at the opposite longitudinal ends of the developing device to transfer the supplied developer conveyed by the screw 161 to another screw 162.

The S-pole 23*d* is a conveying pole for collecting the developer remaining after the developing operation back into the container, and to convey the developer in the container to the regulating portion, by the magnetic field provided thereby.

Adjacent the magnetic pole 23*d*, the fresh developer conveyed by the screw 162 adjacent the sleeve 22 replaces the developer on the sleeve 22 collected after the development.

A conveying screw 164 is effective to make uniform the distribution of the developer amount along the length of the developing sleeve.

The distance $d_2$ between the edge of the non-magnetic blade 24 and the surface of the developing sleeve 22 is 100–900 microns, preferably 150–800 microns. If the distance is smaller than 100 microns, the magnetic carrier particles may clog the clearance, producing a non-uniform developer layer, and preventing application of sufficient amount of the developer with the result of low density and non-uniform density image. Further, the clearance $d_2$ is preferably not less than 400 microns since then it can be avoided that a non-uniform developer layer (clogging at the blade) is produced by foreign matter contained in the developer. If, on the other hand, the distance is larger than 900 microns, the amount of the developer applied on the developing sleeve 22 is too great, and therefore, proper regulation of the thickness of the developer layer can not be performed, the amount of the magnetic particles deposited on the latent image bearing member is increased, and simultaneously, the circulation of the developer which will be described hereinafter and the regulation of the circulation by the developer limiting member 26 are weakened with the result of insufficient triboelectric charge leading to production of foggy background.

In FIG. 1, a line L1 is a line connecting a rotational center of the sleeve 22 and the center of the developer layer thickness regulating pole 23*a*, that is, the maximum magnetic flux density position on the sleeve surface; a line L2 is a line connecting the rotational center of the sleeve 22 and the free edge of the blade 24; and an angle $\theta 1$ is an angle formed between the lines L1 and L2. The angle $\theta 1$ is within the range of −5–35 degrees, preferably 0–25 degrees. If the $\theta 1$ is smaller than −5 degrees, the developer layer formed by the magnetic force, mirror force and coagulating force applied to the developer becomes non-uniform, whereas if it is larger than 35 degrees, the amount of application of the developer on the sleeve by a non-magnetic blade is increased with the result of difficulty in providing a predetermined amount of developer. The negative of the angle $\theta 1$ means that the line L1 is disposed downstream of the line L2 with respect to the rotational direction of the sleeve 22.

Between the magnetic pole 23*d* position and 23*a* position in the container 36, the speed of the developer layer on the sleeve 22 becomes lower away from the sleeve surface due to the balance between the conveying force by the sleeve 22 and the gravity and the magnetic force against it, even though the sleeve 22 is rotated in the direction indicated by an arrow b. Some part of the developer falls by the gravity.

Therefore, by properly selecting the positions of the magnetic poles 23*a* and 23*d*, fluidability of the magnetic particles 27 and the magnetic properties thereof, the developer layer is moved more in the position closer to the sleeve 22, to constitute a moving layer. By the movement of the developer, the developer is conveyed to a developing position together with the rotation of the sleeve 2, and is provided for the developing operation.

Figure 2:
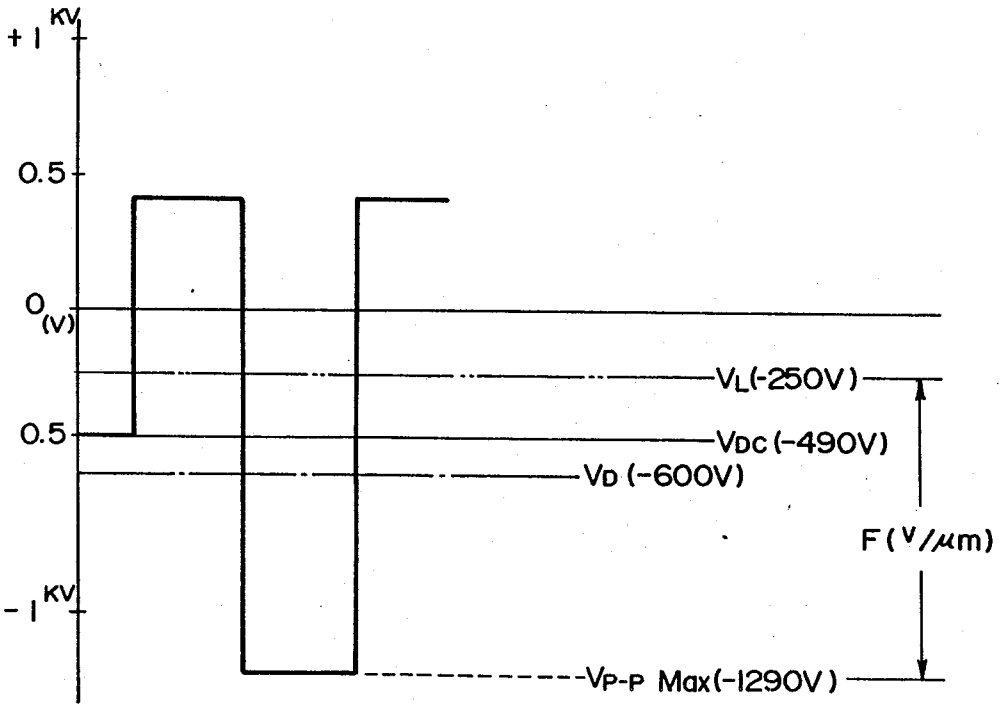
FIG. 2 is a graph showing a schematic pattern of an alternating electric field used in the present invention.

FIG. 2 is a graph illustrating the developing method according to the present invention. FIG. 2 shows an alternating electric field used in a case where a developer is supplied to a developing position (minimum clearance: G (microns)) where an electrostatic image-bearing member is disposed opposite to a developer-carrying member carrying thereon a developer. The developer used herein comprises toner particles, and magnetic particles capable of being charged at a polarity reverse to that of the toner particles.

The alternating electric field shown by FIG. 2 has a rectangular waveform. In such a waveform, in the case of normal development, because the electrostatic image potential ($V_D$ (V)) is negative, the voltage VppMax (V) at the maximum electric field application point is the maximum point of the rectangular wave on the positive side (i.e., upper portion in FIG. 2), and the background potential becomes $V_L$ (V).

On the other hand, in the case of reverse development using such a waveform, because the electrostatic image potential becomes $V_L$ (V), the maximum electric field application point becomes a lower portion in such a figure, and the background potential becomes $V_D$ (V). Incidentally, in the case of the reversal development, the waveform per se providing $V_{DC}$ and Vpp may generally be changed, but it shows a similar tendency as mentioned above.

As described hereinabove, the carrier (magnetic) particles can be attached to an image portion to disturb it. As a result of our investigation on a developing method for preventing the magnetic particles from attaching to the image portion, we have obtained the following knowledge. Incidentally, because a reversal development method is used in this instance, the background part potential $V_D$ is set to −600 V, the electrostatic image potential is set to −250 V, and a DC component is set to −490 V in order to prevent the attachment of toner particles to the background part.

We have conducted various experiments in consideration of many patterns of developing methods, and have found that magnetic particles (carrier particles) are attached to the image portion (or image area) in most cases. If the carrier particles are deposited or attached to the image area, it has been found that the gradational characteristic of the image is partly decreased by the carrier particles, and the image density is also decreased thereby. Therefore, the investigations have been made as to the developing system whereby the carrier deposition to the image area can be further decreased.

We have found a problem peculiar to a mixture developer. That is, by the maximum electric field tending to deposit a large amount of toner particles to the image area, some carrier particles are attached to a photosensitive member. On the basis of this finding, various experiments and considerations have been made including the maximum electric field strength being gradually decreased from such a high level as in the conventional devices, and finally the conditions under which the carrier particle deposition can be significantly decreased. The prevention of the carrier particle deposition was started for the purpose of enhancing the reproducibility of the tone or gradational characteristic of the image, but it was found that if the maximum electric field strength was too weak, the tone reproducibility was not good because of insufficient image density.

FIG. 2 may facilitate the understanding the developing method according to the present invention.

The maximum electric field strength F (V/micron) in the image area is expressed as $$F=(|\mathrm{VppMax}/2|+|V_{DC}-V_L|)/G$$

where $V_L$ (V) is a potential of the image area;

$V_{DC}$ (V) is a voltage of the DC component of the alternating voltage;

VppMax (V) is the voltage at the maximum electric field application point which is at the opposite side of the image portion potential $V_L$ with respect to the potential $V_D$;

G (micron) is the minimum clearance between the surface of the image bearing member (sleeve) and the surface of the electrostatic latent image bearing member (photosensitive member).

We have found that the attachment of the magnetic particles is prevented and the gradational characteristic is good in the range of $1.5 \leqq F \leqq 3.5$. When $F > 3.5$, the magnetic particles are uniformly attached to the image portion at a certain proportion, the transparency of the whole image is impaired and image unevenness occurs at the time of transfer. On the other hand, when $F < 1.5$, the attachment of the magnetic particles is effectively prevented but the sharpness of line images is lowered and the image density is lowered. A relationship of $1.5 \leqq F \leqq 3.0$ (more preferably $2 \leqq F \leqq 3.0$) is further preferred.

In the above-mentioned embodiment wherein a developer is reciprocated by using an alternating electric field, the developing efficiency is high and is effective in the case of an image of large area and a large toner consumption such as full-color copying. In such an embodiment, however, because the developer is reciprocated, the toner particles are liable to be released from the magnetic particles, whereby toner scattering is liable to occur. Accordingly, the developer may desirably be one having a function of reducing the toner scattering.

However, in the prior art, when the volume-average particle size of the toner is small, charge amount of the developer in various environmental conditions are considerably different from each other, whereby it is difficult to simultaneously satisfy the image density and the prevention of toner scattering. For example, when toner scattering becomes problematic under a condition corresponding to a small charge amount, the toner scattering can be prevented by increasing the charge amount. However, in such case, a large charge amount under a condition originally corresponding to such an amount is further increased, whereby a low image density in an original state is further lowered. Accordingly, it has been difficult to simultaneously satisfy the image density and the prevention of toner scattering.

On the contrary, in the present invention, charge amounts under different environmental conditions are little different from each other. As a result, under various environmental conditions, it is easy to control the charge amount so that it may simultaneously satisfy the image quality and the prevention of the toner scattering.

The magnetic particles can be attached to the non-image area in addition to the image area, but in the present invention, the attachment of the magnetic particles to the non-image area may suitably be prevented because of the above-mentioned reason.

In order to further decrease the magnetic particle deposition to the non-image area, it is preferable that $50 \leqq |V_{DC} - V_L| \leqq 200$ is satisfied even when the DC component $V_{DC}$ of the alternating voltage is variable in response to the non-image area potential $V_L$ (V). Since the non-image area potential may vary together with change in the ambient condition, and therefore, in order to assure the toner deposition, the absolute value of $V_{DC} - V_L$ is preferably not more than 150 (V).

An additional preferable conditions are $0.8 \leqq \nu \leqq 3.0$ (more preferably $0.8 \leqq \nu \leqq 2.2$), where $\nu$ is a frequency (KHz) of the alternating electric field. If the frequency is below 0.8 KHz, fog increases. If the frequency is above 2.2 KHz (particularly, above 3.0 KHz), the sharpness and gradational characteristic of a line image deteriorate.

In the developing method according to the present invention, the developer layer may be in contact with the latent image bearing member or not, under no application of an alternating electric field.

Further, the combination of such developing method and the above-mentioned developer is preferred from the following viewpoint.

Because the fluidity improver having a weak chargeability contained in the developer has a weak adhesion force to a latent image formed on a photosensitive member, it has a tendency not to be consumed in a developing step but to be accumulated in a developing device. However, in the present invention, because the fluidity improver has a good opportunity to contact the photosensitive member, the above-mentioned tendency may be obviated.

Now, the description will be made with respect to the relative volumetric ratio which defines the amount of the developer conveyed into the developing position in the developing device having the structure described above. The relative volumetric ratio is defined in the developing position or zone where the toner particles are transferred or supplied from the sleeve 22 to the photosensitive drum 1.

The relative volumetric ratio is defined by an amount M (g/cm$^2$) of the developer (mixture of the magnetic carrier particles and toner particles) per a unit area of the surface of the sleeve 22, a height h (cm) of the developing zone space (the distance between the sleeve surface and the drum surface), a true density $\sigma$ (g/cm$^3$) of the magnetic carrier particles, weight content of the carrier particles on the surface of the sleeve C/(T+C) (%) (C is a weight of the carrier particles, and T is a weight of the toner particles), and a relative speed ratio $\sigma$ between the sleeve 22 and the photosensitive member 1. More particularly, the relative volumetric ratio Q is defined as $$Q = (M/h) \times (1/\sigma) \times [C/(T+C)] \times \sigma \times 100$$

The relative volumetric ratio Q is influenced by the structure of the developing device described hereinbefore, more particularly, by the positions of the magnetic poles of the magnet roller 23, the strengths of the magnetic poles, configuration of the developer limiting member 26, or the distance $d_2$ between the edge of the non-magnetic blade 24 and the surface of the sleeve 22. The relative volumetric ratio Q considerably affects copied images, particularly their image density.

We have conducted various experiments and tests under various conditions, noting the relations between the volumetric ratio Q and the image density. As a result, it has been found that good color copy images can be provided if the relative volumetric ratio Q is $15.0 \leqq Q \leqq 45.0$ (%) (more preferably $15.0 \leqq Q \leqq 28.0$ (%)). Further, it has been found that if the ratio Q is in the above-mentioned range, stable images are obtained even when environmental conditions change.

The above-mentioned developing conditions as a preferred embodiment of the developing method according to the present invention are those based on the following discovery.

It has been found that the image density and image quality are not monotonously changed depending on the amount of a developer to be applied onto the sleeve 22 and an increase or decrease in the developing zone space. However, it has been found that if the above-mentioned relative volumetric ratio Q (i.e., the volumetric amount of the magnetic particles passing through the developing zone per unit time) is in the range of 15.0–45.0% (preferably 15.0–28.0 sufficient and stable image density is obtained. If the ratio Q is smaller than 15.0% or larger than 45.0%, there occurs somewhat of a decrease in the image density and a decrease in image quality which are not desirable in a color copy image. Further, it has been found that sleeve ghost (i.e., unevenness in the toner coating in a portion wherein toner particles have been consumed in the prior developing step) or fog does not occur when the ratio Q is in the above-mentioned range providing the above-mentioned sufficient image quality.

When the relative volumetric ratio is in the range of 15.0–45.0%, the chains (or ears) of the carrier particles are formed on the sleeve surface 22 and are distributed sparsely to a satisfactory extent, so that the toner particles on the chain surfaces and those on the sleeve surfaces are sufficiently opened toward the photosensitive drum 1, and the toner 102 on the sleeve are transferred to the photosensitive drum 1 under the existence of the alternating electric field. Thus, almost all of the toner particles are consumable for the purpose of development. Accordingly, the development efficiency (the ratio of the toner consumable for the development to the overall toner present in the developing position) and also a high image density can be provided. The fine but violent vibration of the carrier chains is preferably produced by the alternating electric field, by which the toner powder deposited on the magnetic particles and the sleeve surface are sufficiently loosened. In any case, the trace of brushing or occurrence of the ghost image as in the magnetic brush development can be prevented. Additionally, the vibration of the chains enhances the frictional contact between the magnetic particles 27 and the toner particles 28, with the result of the increased triboelectric charging to the toner particles 28, by which the occurrence of the foggy background can be prevented.

The desirable range of the relative volumetric ratio Q is as described above. It is further preferable that the ratio of the sleeve peripheral speed to that of the photosensitive member, that is the relative speed ratio $\sigma$ is $1.2<\sigma\leqq 2.5$. The relative speed ratio $\sigma$ used herein is represented by the following formula:

$$\sigma = a/b,$$

wherein a denotes the peripheral speed of a sleeve, and b denotes the peripheral speed of a photosensitive member.

If $\sigma>1.2$, the developing efficiency may be increased. If the relative speed ratio $\sigma>2.5$, the image density in the solid image is not uniform, in such a form as when powder is swept together.

Hereinbelow, various methods (1) to (8) for measuring the physical properties characterizing the toner according to the present invention are inclusively described.

(1) Particle size distribution

Coulter Counter Model TA-II (available from Coulter Electronics Inc.) is used as an instrument for measurement, to which an interface (available from Nikkaki K.K.) for providing a number-basis distribution, a volume-basis distribution, a number-average particle size and a volume-average particle size, and a personal computer CX-1 (available from Canon K.K.) are connected.

For measurement, a 1%-NaCl aqueous solution as an electrolytic solution is prepared by using a reagent grade sodium chloride. Into 100 to 150 ml of the electrolytic solution, 0.1 to 5 ml of a surfactant, preferably an alkylbenzenesulfonic acid salt, is added as a dispersant, and 0.5 to 50 mg, preferably 2 to 20 mg, of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter Counter Model TA-II with a 100 microns-aperture to obtain a volume-basis distribution and a number-basis distribution. From the results of the volume-basis distribution and number-basis distribution, the volume-average particle size, the percentage (%) by number of toner particles having particle sizes of below 6.35 microns, and the percentage (%) by volume of particles having particle sizes of above 16.0 microns of the sample toner are calculated.

(2) Triboelectric charge

Figure 4:
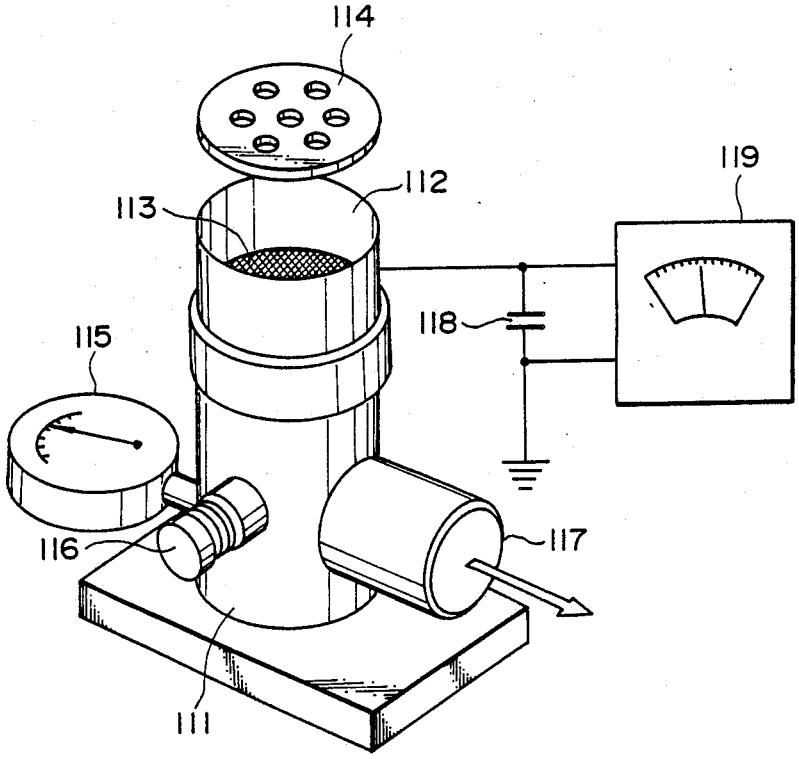
FIG. 4 is a schematic perspective view showing a device for measuring an amount of charge.

An instrument as shown in FIG. 4 is used, for measurement of a triboelectric charge. First, there is prepared a mixture comprising sample particles to be measured and magnetic particles used herein. In the case of toner particles or colored resin particles, 5 g of such particles are mixed with 95 g of magnetic particles. In the case of a fluidity improver, 2 g of fluidity improver is mixed with 98 g of magnetic particles.

The sample particles and the magnetic particles used for the measurement are left standing for at least 12 hours in the environment of 23° C. and 60% RH before the measurement. The measurement of triboelectric charge is also conducted in the environment of 23° C. and 60% RH.

The above-mentioned mixture is charged in a polyethylene bottle with a volume of 100 ml and reciprocally shaked by means of a tubular mixer (3 cycles/sec) sufficiently (e.g., 60 times). Then, the shaken mixture (sample particles +magnetic particles) is charged in a metal container 112 for measurement provided with a 500-mesh screen 113 at the bottom as shown in FIG. 4 and covered with a metal lid 114. Incidentally the mesh size can appropriately be changed so that the magnetic particles do not pass through the screen 113. The total weight of the container 112 is weighed and denoted by $W^1$ (g). Then, an aspirator 111 composed of an insulating material at least with respect to a part contacting the container 112 is operated, and the toner in the container is removed by suction through a suction port 117 sufficiently (preferably for about two minutes) while controlling the pressure at a vacuum gauge 115 at 250 mm.Aq. by adjusting an aspiration control valve 116. The reading at this time of a potential meter 119 connected to the container by the medium of a capacitor 118 having a capacitance C ($\mu$F) is denoted by V (volts). The total weight of the container after the aspiration is measured and denoted by $W^2$ (g). Then, the triboelectric charge ($\mu$C/g) of the sample is calculated as: $CxV/(W_1-W_2)$.

The magnetic particles used for the measurement are ferrite particles coated with a styrene type resin and comprise 70 wt. % or more, preferably 75–95 wt. %, of particles having sizes between 250 to 400 mesh. More specifically, the particles are ferrite particles coated with 0.2–0.7 wt. % of a styrene-2ethylhexyl acrylate-methyl methacrylate copolymer.

(3) Apparent viscosity

Flow Tester Model CFT-500 (available from Shimazu Seisakusho K.K.) is used. Powder having passed through a 60-mesh sieve is used as a sample and weighed in about 1.0 to 1.5 g. The sample is pressed under a pressure of 100 kg/cm$^2$ for 1 minute by using a tablet shaper.

The pressed sample is subjected to measurement by means of Flow Tester in an environment of temperature of about 20° to 30° C. and relative humidity of 30–70% under the following conditions:

| | | |
|---|---|---|
| RATE TEMP | 6.0 | D/M (°C./min) |
| SET TEMP | 70.0 | DEG (°C.) |
| MAX TEMP | 200.0 | DEG |
| INTERVAL | 3.0 | DEG |
| PREHEAT | 300.0 | SEC |
| LOAD | 20.0 | KGF (kg) |
| DIE (DIA) | 1.0 | MM (mm) |
| DIE (LENG) | 1.0 | MM |
| PLUNGER | 1.0 | CM$^2$ (cm$^2$) |

From the resultant Temperature-Apparent density cure, the apparent viscosities of the sample at 90° C. and 100° C. are read and recorded. (4) Resistivity of magnetic particles The resistivity of the magnetic particles is measured with a sandwiching type cell having a measuring electrode area of 4 cm$^2$ and having a clearance of 0.4 cm between the electrodes. One of the electrodes is imparted with 1 kg weight, and a voltage E(V/cm) is applied across the electrodes, and the resistivity of the magnetic particles is determined from the current through the circuit.

(5) Agglomeration degree

The agglomeration degree is used as a measure for evaluating the fluidity of a sample (e.g., a toner composition containing an external additive). A higher agglomeration degree is judged to represent a poorer fluidity of the sample.

As an instrument for measurement, Powder Tester (available from Hosokawa Micron K.K.) is used.

For measurement, a 60-mesh sieve, a 100 mesh-sieve and a 200-mesh sieve are superposed in this order from the above and set on a vibration table. An accurately measured sample in an amount of 5 g is placed on the 60-mesh sieve, and the vibration table is subjected to vibration for about 15 seconds under the conditions of an input voltage to the vibration table of 21.7 V, and a vibration amplitude in the range cf 60–90 microns (a rheostat scale: about 2.5). The weights of the sample remaining on the respective sieves are measured to calculate the agglomeration from the following equation:

$$\text{Agglomerationdegree}(\%) = (\text{sample weight on 60-mesh sieve}/5\text{ g}) \times 100 + (\text{sample weight on 100-mesh sieve}/5\text{ g}) \times 100 \times 35 + (\text{sample weight on 200-mesh sieve}/5\text{ g}) \times 100 \times 1/5$$

The sample before the measurement is left standing under the conditions of 23° C. and 60% RH and is subjected to measurement under the conditions of 23° C. and 60% RH.

(6) Hydrophobicity

The hydrophobicity of silica fine powder having a surface imparted with a hydrophobicity is measured by the methanol titration test, which is conducted as follows.

Sample silica fine powder (0.2 g) is charged into 50 ml of water in a 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica particles is suspended in the liquid, and the hydrophobicity is represented by the percentage of the methanol in the liquid mixture of water and methanol on reaching the end point.

(7) Apparent density

Powder Tester (available from Hosokawa Micron K.K.) is used for measurement of the apparent density. A 60-mesh sieve is placed on a vibration table, and right under the sieve, a preliminary weighed 100 cc cup for measurement of apparent density is placed. Then, vibration is started at a rheostat scale of 2.0. A sample is gently poured on the vibrating 60-mesh sieve so as to pass through the sieve into the cup. When the cup is filled with a heap of the sample, the vibration is terminated and the heap of the sample is leveled at the top of the cup. Then, the sample is weighed accurately by a balance.

As the inner volume of the cup for measurement is 100 cc, the apparent density (g/Cm$^3$) of the sample is obtained as the sample weight (g)/100.

The sample before the measurement is left standing under the conditions of 23° C. and 60% RH and is subjected to measurement under the conditions of 23° C. and 60% RH.

(8) Heat-adsorption peaks according to DSC

DSC stands for differential scanning colorimetry.

A differential scanning calorimeter DSC 7 (available from Perkin Elmer Corp.) is used.

A sample is accurately weighed in 5–20 mg, preferably about 10 mg. The sample is placed on an aluminum pan with the used of an empty aluminum pan as the reference and is subjected to DSC in the temperature range of 30° C. to 200° C. at a temperature raising rate of 10° C./min in the environment of normal temperature and normal humidity. The absorption peak referred to herein is a temperature at which a main absorption peak is observed in the temperature range of 40–100° C.

The toner or developer according to the present invention can further contain another optional additive. Examples thereof include: lubricants including fatty acid metal Salts such as zinc stearate and aluminum stearate, and fine powder of fluorine-containing resins such as polytetrafluoroethylene, polyvinylidene fluoride and tetrafluoroethylenevinylidene fluoride copolymer; abrasives such as cerium oxide and silicon carbide; and electroconductivity-imparting agent such as tin oxide and zinc oxide.

The colored resin particles according to the present invention may be produced by sufficiently mixing thermoplastic resin such as those enumerated hereinbefore and a pigment or dye as colorant, and optionally, a charge controller, another additive, etc., by means of a mixer such as a ball mill, etc.; then melting and kneading the mixture by hot kneading means such as hot rollers, kneader and extruder to disperse or dissolve the pigment or dye, and optional additives, if any, in the melted resin; cooling and crushing the mixture; and subjecting the powder product to precise classification to form colored resin particles according to the present invention.

Hereinbelow the present invention is more specifically explained with reference to specific Examples and comparative Examples.

EXAMPLE 1

| | |
|---|---|
| Polyester resin obtained by condensation of propoxidized bisphenol and fumaric acid (weight-average molecular weight (Mw) = 17,000, number-average molecular weight (Mn) = 3,500) | 100 wt. parts |
| Phthalocyanine pigment | 5 wt. parts |
| Chromium complex of di-tertialy-butylsalicylic acid | 4 wt. parts |

A mixture containing the above ingredients in the prescribed amounts was sufficient pre-mixed by means of a Henschel mixer and then melt-kneaded on a three-roll mill at least two times. After cooling, the kneaded product was coarsely crushed to about 1–2 mm by using a hammer mill and then finely pulverized by means of a pulverizer based on an air-jet system. The fine pulverized product was classified by means of a multi-division classifier to obtain negatively chargeable cyan-colored resin particles.

The thus obtained colored resin particles had a volume-average particle size of 8.3 microns; a number-bias distribution wherein the proportion of particles having a particle size of 5 microns or below was 25% by number and the proportion of particles having a particle size of 6.35–10.1 microns was 46% by number; and a volume-basis distribution wherein the proportion of particles having a particle size of 6.35–10.1 microns was 67% by volume, the proportion of particles having a particle size of 12.7–16.0 microns was 1.6% by volume, and the proportion of particles having a particle size of above 16.0 microns was zero %.

100 wt. parts of the above-mentioned colored resin particles was mixed with 0.3 wt. part (about 0.3 wt. %) of alumina fine powder (charge amount: $-3$ $\mu c/g$) having a BET specific surface area of 100 $m^2/g$, and 0.5 wt. part (about 0.5 wt. %) of silica fine powder (charge amount: $-80$ $\mu c/g$) having a BET specific surface area of 250 $m^2/g$ which had been treated with a hydrophobicity-imparting agent (hexamethyldisilazane), to obtain a cyan toner.

The thus obtained cyan toner had an apparent viscosity of $6.00\times10^5$ poise (at 90° C.) and $1.1\times10^4$ poise (at 100° C.), an apparent density of 0.35 $g/cm^2$, and a heat-absorption peak according to DSC of 67.2° C.

Physical properties of the toner are shown in Table 1 appearing hereinafter, and those of fluidity improver (i.e., alumina fine powder and hydrophobic silica fine powder) are shown in Table 2 appearing hereinafter.

6 wt. parts of the cyan toner was mixed with 94 wt. parts of a Cu-Zn-Fe-basis ferrite carrier (composition wt. ratio =15:15:70) surface-coated with 0.5 wt. % of a styrene-methyl methacrylate-2ethylhexyl acrylate copolymer (copolymerization wt. ratio =45:35:20, weight-average molecular weight (mw)=5000, number-average molecular weight (Mn)=2000), whereby a two-component developer was prepared. The ferrite particles used herein had a volume-average particle size of 52 microns, and contained substantially zero % of magnetic particles having a particle size of 10 microns or below; 3 wt. % of magnetic particles having a particle size of below 26 microns; 9 wt. % of magnetic particles having a particle size of 26 or above and below 35 microns; 12 wt. % of magnetic particles having a particle size of 35 microns or above and below 43; and 0.1 wt. % of magnetic particles having a particle size of 74 microns or above.

The thus prepared developer was charged in a developing device as shown in FIG. 1, wherein the clearance between a developing sleeve 22 and a cut blade 24 was set to 650 microns. The developing device was assembled in a color laser copying machine using a digital developing system and a reversal developing system (trade name: PIXEL, mfd. by Canon K.K.) which had been modified so as to effect reversal development.

In the copying machine, the clearance between a photosensitive drum 1 (outside diameter: 80 mm) comprising an organic photoconductor (OPC), and the sleeve 22 (outside diameter: 32 mm) was set to 500 microns, and the peripheral speed ratio $\sigma$ between the photosensitive drum 1 and the developing sleeve 22 was set to 1.7. The photosensitive drum 1 was charged so as to have a latent image potential of $-700$ V and was imagewise exposed to light to have an exposure latent image potential of $-150$ V. In the development, there was used a bias voltage obtained by an AC voltage having a frequency of 2000 Hz and a peak-to-peak value of 2000 V on a DC voltage of $-550$ V. In such development, the relative volume ratio Q was 25.7 (%), and the maximum electric field intensity F was 2.80 (V/micron).

By using the above-mentioned combination, there was obtained a very good image without fog or attachment of magnetic particles with respect to the image density obtained in an initial stage.

Further, when successive copying was conducted under normal temperature-normal humidity (23° C., 60% RH) conditions, very good images having an image density of 1.45–1.60 were obtained. When a color transparency for OHP (overhead projector) was prepared by using the above-mentioned developer, and the resultant projection image was observed, a clear image without a shadow due to attachment of magnetic particles was obtained.

Further, when successive copying was also conducted under low temperature-low humidity (15° C., 10 % RH) conditions, good images having an image density of 1.40–1.50 were obtained. When successive copying was conducted in the same manner under high temperature-high humidity (32.5° C., 85% RH), good images having an image density of 1.50–1.60 were obtained and no toner scattering was observed.

The above-mentioned results including developing characteristics are shown in Table 3 appearing hereinafter.

Hereinbelow, the multi-division classifier and the classification step used in this instance are explained with reference to FIGS. 1 and 2.

Figure 6:
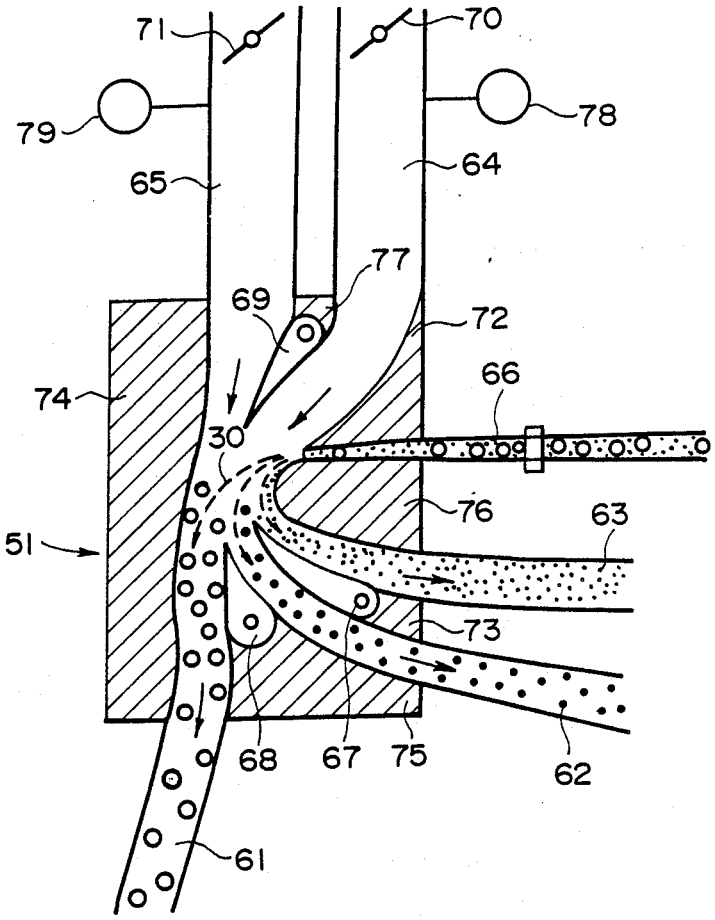
FIGS. 6 and 7 are a front sectional view and a sectional perspective view, respectively, of an apparatus embodiment for practicing multi-division classification.
Figure 7:
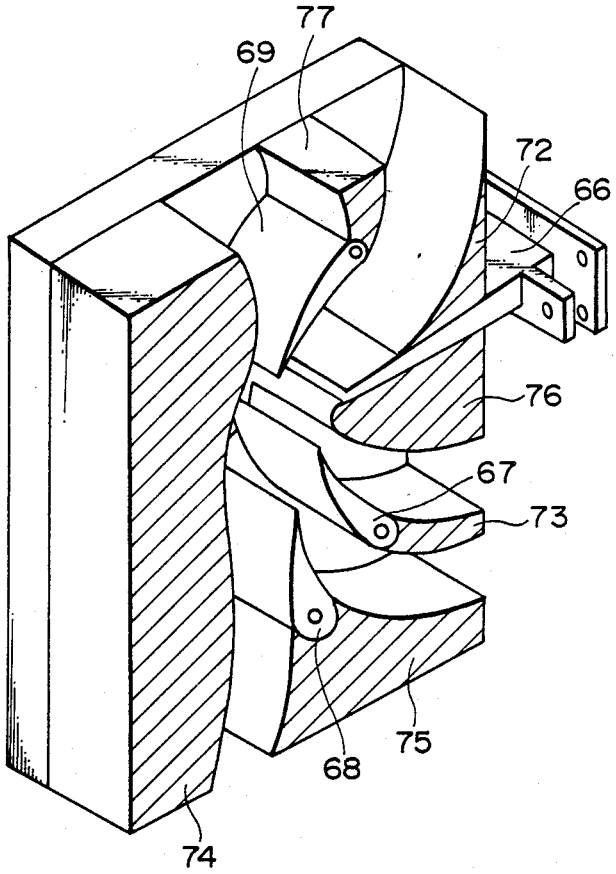

Referring to FIGS. 6 and 7, the multi-division classifier has side walls 72, 73 and 74, and a lower wall 75. The side wall 73 and the lower wall 75 are provided with knife edge-shaped classifying wedges 68 and 68, respectively, whereby the classifying chamber is divided into three sections. At a lower portion of the side wall 72, a feed supply nozzle 66 opening into the classifying chamber is provided. A Coanda block 76 is disposed along the lower tangential line of the nozzle 66 so as to form a long elliptic arc shaped by bending the tangential line downwardly. The classifying chamber has an upper wall 77 provided with a knife edge-shaped gas-intake wedge 69 extending downwardly. Above the classifying chamber, gas-intake pipes 64 and 65 opening into the classifying chamber are provided. In the intake pipes 64 and 65, a first gas introduction control means 70 and a second gas introduction control means 71, respectively, comprising, e.g., a damper, are provided; and also static pressure gauges 78 and 79 are disposed communicatively with the pipes 64 and 65, respectively. At the bottom of the classifying chamber, exhaust pipes 61, 62 and 63 having outlets are disposed corresponding to the respective classifying sections and opening into the chamber.

Feed powder to be classified is introduced into the classifying zone through the supply nozzle 66 under reduced pressure. The feed powder thus supplied is caused to fall along curved lines 80 due to the coanda effect given by the Coanda block 76 and the action of the streams of high-speed air, so that the feed powder is classified into coarse powder 61, cyan colored fine powder 62 having prescribed volume-average particle size and particle size distribution, and ultra-fine powder 63.

EXAMPLE 2

Colored resin particles were prepared in the same manner as in Example 1 except that micropulverization and classification conditions were controlled to obtain colored resin particles having characteristics as shown in Table 1 appearing hereinafter.

The thus obtained colored resin particles had a volume-average particle size of 8.0 microns; a number-bias distribution wherein the proportion of particles having a particle size of 5 microns or below was 36% by number and the proportion of particles having a particle size of 6.35–10.1 microns was 38% by number; and a volume-basis distribution wherein the proportion of particles having a particle size of 6.35–10.1 microns was 65% by volume, the proportion of particles having a particle size of 12.7–16.0 microns was 1.6% by volume, and the proportion of particles having a particle size of above 16.0 microns was zero %.

A two-component developer was prepared in the same manner as in Example 1 except that the above-prepared colored resin particles were used, and the thus obtained developer was subjected to an image formation test in the same manner as in Example 1. The results are shown in Table 3 appearing hereinafter. Example 3

| | |
|---|---|
| Polyester resin obtained by condensation of propoxidized bisphenol and fumaric acid (Mw = 17,000, Mn = 3,500) | 100 wt. parts |
| Rhodamine pigment | 3 wt. parts |
| Chromium complex of di-tertialy-butylsalicylic acid | 4 wt. parts |

By using the above ingredients, colored resin particles were prepared in the same manner as in Example 1, to obtain magenta-colored resin particles having characteristics as shown in Table 1 appearing hereinafter.

The thus obtained colored resin particles had a volume-average particle size of 8.5 microns; a number-bias distribution wherein the proportion of particles having a particle size of 5 microns or below was 18% by number and the proportion of particles having a particle size of 6.35–10.1 microns was 55% by number; and a volume-basis distribution wherein the proportion of particles having a particle size of 6.35–10.1 microns was 69% by volume, the proportion of particles having a particle size of 12.7–16.0 microns was 2.6% by volume, and the proportion of particles having a particle size of above 16.0 microns was 0.1% by volume.

100 wt. parts of the above-mentioned colored resin particles was mixed with 0.4 wt. part of alumina fine powder (charge amount: substantially zero) having a BET specific surface area of 95 $m^2/g$, and 0.4 wt. part of silica fine powder (charge amount: 90 $\mu c/g$) having a BET specific surface area of 150 $m^2/g$ which had been treated with a hydrophobicity-imparting agent (dimethyldichlorosilane), to obtain a magenta toner.

A two-component developer was prepared in the same manner as in Example 1 except that the above-prepared colored resin particles were used, and the thus obtained developer was subjected to an image formation test in the same manner as in Example 1. The results are shown in Table 3 appearing hereinafter.

EXAMPLE 4

| | |
|---|---|
| Polyester resin obtained by condensation of propoxidized bisphenol and fumaric acid (Mw = 17,000, Mn = 3,500) | 100 wt. parts |
| C.I. Pigment Yellow 17 | 3.5 wt. parts |
| Chromium complex of di-tertialy-butylsalicylic acid | 4 wt. parts |

By using the above ingredients, colored resin particles were prepared in the same manner as in Example 1, to obtain negatively chargeable yellow-colored resin particles having characteristics as shown in Table 1 appearing hereinafter.

The thus obtained colored resin particles had a volume-average particle size of 7.7 microns; a number-basis distribution wherein the proportion of particles having a particle size of 5 microns or below was 31% by number and the proportion of particles having a particle size of 6.35–10.1 microns was 42% by number; and a volume-basis distribution wherein the proportion of particles having a particle size of 6.35–10.1 microns was 65% by volume, the proportion of particles having a particle size of 12.7–16.0 microns was 0.5% by volume, and the proportion of particles having a particle size of above 16.0 microns was zero %.

Hydrophobic silica and alumina powder were mixed with the above-mentioned yellow-colored resin particles in the same manner as in Example 1 to obtain a yellow toner.

A two-component developer was prepared by mixing the yellow toner with ferrite carrier coated with a resin in the same manner as in Example 1, and the thus obtained developer was subjected to an image formation test in the same manner as in Example 1. The results are shown in Table 3 appearing hereinafter.

EXAMPLES 5–8

Cyan toners were prepared in the same manner as in Example 1 except that colored resin particles and fluidity improvers as shown in Tables 1 and 2 were respectively used, and were subjected to an image formation test in the same manner as in Example 1. The results are shown in Table 3 appearing hereinafter.

As apparent from Table 3, the toner obtained in Example 1 was particularly excellent in durability and fog, as compared with those obtained in Examples 5–8.

Comparative Example 1

Cyan-colored resin particles were prepared in the same manner as in Example 1 except that micropulverization and classification conditions were controlled to obtain colored resin particles having characteristics as shown in Table 1 appearing hereinafter.

The thus obtained colored resin particles had a volume-average particle size of 11.1 microns; a number-basis distribution wherein the proportion of particles having a particle size of 5 microns or below was 8% by number and the proportion of particles having a particle size of 6.35–10.1 microns was 52% by number; and a volume-basis distribution wherein the proportion of particles having a particle size of 6.35–10.1 microns was 36% by volume, the proportion of particles having a particle size of 12.7–16.0 microns was 20.2% by volume, and the proportion of particles having a particle size of above 16.0 microns was 3.0% by volume.

A cyan toner and a two-component developer were prepared in the same manner as in Example 1 except that the above-prepared colored resin particles were used, and the thus obtained developer was subjected to an image formation test in the same manner as in Example 1. The results are shown in Table 3 appearing hereinafter.

As shown in shown in Table 3, the gradational characteristic in a highlight portion having a low image density of about 0.2–0.6 was inferior to that obtained in Example 1.

TABLE 1

| | Volume-ave. particle size dv (μm) | % by number of particles ≦5 μm | % by volume of particles of 12.7–16.0 μm | % by volume of particles ≧16 μm | $\frac{V\sqrt{dv}}{N}$ | Apparent density (g/cm³) | Agglomeration degree (%) | Apparent viscosity (poise) 90° C. | Apparent viscosity (poise) 100° C. | Heat-absorption peak (°C.) |
|---|---|---|---|---|---|---|---|---|---|---|
| Ex. 1 | 8.3 | 25 | 1.6 | 0 | 12.1 | 0.45 | 13.5 | $6.0 \times 10^5$ | $1.1 \times 10^4$ | 67.2 |
| 2 | 8.0 | 36 | 1.6 | 0 | 13.7 | 0.42 | 15.3 | $6.0 \times 10^5$ | $1.1 \times 10^4$ | 67.2 |
| 3 | 8.5 | 17 | 2.6 | 0.1 | 10.5 | 0.47 | 11.6 | $5.7 \times 10^5$ | $5.8 \times 10^4$ | 67.8 |
| 4 | 7.7 | 31 | 0.5 | 0 | 11.9 | 0.43 | 16.2 | $9.0 \times 10^5$ | $9.0 \times 10^4$ | 66.8 |
| 5 | 8.3 | 25 | 1.6 | 0 | 12.1 | 0.46 | 15.8 | $6.0 \times 10^5$ | $1.1 \times 10^4$ | 67.2 |
| 6 | 8.3 | 25 | 1.6 | 0 | 12.1 | 0.52 | 26.3 | $6.0 \times 10^5$ | $1.1 \times 10^4$ | 67.2 |
| 7 | 8.3 | 25 | 1.6 | 0 | 12.1 | 0.46 | 20.2 | $6.0 \times 10^5$ | $1.1 \times 10^4$ | 67.2 |
| 8 | 7.9 | 42.0 | 1.7 | 0.1 | 15.3 | 0.40 | 18.3 | $6.0 \times 10^5$ | $1.1 \times 10^4$ | 67.2 |
| Comp. Ex. 1 | 11.1 | 8.0 | 20.2 | 3.0 | 7.7 | 0.48 | 10.8 | $6.0 \times 10^5$ | $1.1 \times 10^4$ | 67.2 |

TABLE 2

| | Fluidity improver | | | | | | | | |
|---|---|---|---|---|---|---|---|---|---|
| | Hydrophobic inorganic oxide | BET specific surface area (m²/g) | Charging characteristic (μc/g) 60 times | Charging characteristic (μc/g) 30,000 times | Addition amount (wt. %) | Hydrophilic inorganic oxide | BET specific surface area (m²/g) | Charging characteristic (μc/g) (60 times) | Addition amount (wt. %) |
| Ex. | | | | | | | | | |
| 1 | Silica*1 | 250 | −80 | −55 | about 0.5 | alumina | 100 | −3 | about 0.3 |
| 2 | Silica*1 | 250 | −80 | −55 | about 0.5 | alumina | 100 | −3 | about 0.3 |
| 3 | Silica*2 | 150 | −90 | −95 | about 0.4 | alumina | 95 | 0 | about 0.4 |
| 4 | Silica*1 | 250 | −80 | −55 | about 0.5 | alumina | 100 | −3 | about 0.3 |
| 5 | Silica*2 | 220 | −40 | −60 | about 0.8 | — | — | — | — |
| 6 | — | — | — | — | — | alumina | 120 | −3 | about 0.99 |
| 7 | Silica*1 | 250 | −80 | −55 | about 0.5 | titanium oxide | 20 | +5 | about 0.5 |
| 8 | Silica*1 | 250 | −80 | −55 | about 0.5 | alumina | 100 | −3 | about 0.5 |
| Comp. Ex. 1 | Silica*1 | 250 | −80 | −55 | about 0.5 | alumina | 100 | −3 | about 0.5 |

*1Dry-process silica fine powder treated with hexamethyldisilazane.
*2Dry-process silica fine powder treated with dimethyldichlorosilane.

TABLE 3A

| | Charge amount of toner (μc/g) N/N | L/L | H/H | Image density (N/N) Initial | 1000 sheets | 5000 sheets | 10000 sheets | (L/L) 1000 sheets | (H/H) 1000 sheets |
|---|---|---|---|---|---|---|---|---|---|
| Ex. | | | | | | | | | |

TABLE 3A-continued

| | Charge amount of toner (μc/g) | | | Image density (N/N) | | | | (L/L) | (H/H) |
|---|---|---|---|---|---|---|---|---|---|
| | N/N | L/L | H/H | Initial | 1000 sheets | 5000 sheets | 10000 sheets | 1000 sheets | 1000 sheets |
| 1 | −30 | −35 | −25 | 1.50 | 1.50 | 1.53 | 1.50 | 1.42 | 1.58 |
| 2 | −31 | −38 | −26 | 1.50 | 1.48 | 1.51 | 1.45 | 1.40 | 1.55 |
| 3 | −25 | −32 | −23 | 1.56 | 1.55 | 1.58 | 1.60 | 1.51 | 1.60 |
| 4 | −32 | −40 | −27 | 1.50 | 1.52 | 1.51 | 1.55 | 1.46 | 1.55 |
| 5 | −38 | −56 | −27 | 1.50 | 1.42 | 1.35 | 1.30 | 1.55 | 1.57 |
| 6 | −13 | −17 | −10 | 1.50 | 1.52 | 1.55 | 1.56 | 1.48 | 1.75 |
| 7 | −29 | −38 | −21 | 1.50 | 1.48 | 1.42 | 1.36 | 1.35 | 1.65 |
| 8 | −36 | −42 | −30 | 1.50 | 1.45 | 1.52 | 1.39 | 1.38 | 1.55 |
| Comp. Ex. 1 | −23 | −27 | −19 | 1.50 | 1.48 | 1.53 | 1.50 | 1.45 | 1.56 |

TABLE 3B

| | Fog*1 (N/N) | | | Toner scattering*2 (N/N) | Gradational characteristic in highlight portion*3 |
|---|---|---|---|---|---|
| | Initial | 1000 sheets | 5000 sheets | | |
| Ex. 1 | 0.5% | 0.8% | 1.1 | | |
| 2 | 0.6 | 1.0 | 1.3 | | |
| 3 | 0.6 | 0.8 | 1.2 | | |
| 4 | 0.6 | 1.0 | 1.3 | | Δ |
| 5 | 0.5 | 0.7 | 1.0 | | |
| 6 | 0.5 | 1.0 | 1.5 | Δ | |
| 7 | 0.7 | 1.0 | 2.0 | | |
| 8 | 0.5 | 1.0 | 1.6 | Δ | |
| Comp. Ex. 1 | 0.5 | 1.0 | 1.3 | Δ | x |

The values in the above Table 3 were measured in the following manner.

*1: Fog

Fog was evaluated by means of a reflectometer (Model: TC-6DS, mfd. by Tokyo Denshoku K.K.). The yellow toner image, cyan toner image, and magenta toner image were measured by using blue, amber and green filters, respectively. Based on such measurement, the fog value (reflectivity) was calculated according to the following formula:

Fog (%)=(reflectivity (%) of standard paper)−(reflectivity) (%) of the non-image area of the sample).

The smaller value represents less fog.

*2: Toner scattering

After successive copying test of 5,000 sheets, the state of the toner scattering in the neighborhood of the developing device was observed with the eyes.

. . . Very good
o . . . Good
Δ . . . Average

*3: Gradational characteristic

Gradational characteristic in the highlight portion was evaluated by observing a copy image obtained from an original image having a dot portion area of about 10%.

o . . . Good
oΔ . . . Somewhat good
x . . . Coarsening of the image was observed.

EXAMPLE 9

A full-color copy image was formed in the same manner as in Example 1 except for using the two-component developer containing the cyan toner obtained in Example 1, the two-component developer containing the magenta toner obtained in Example 3, and the two-component developer containing the yellow toner obtained in Example 4.

As a result, there was obtained a full-color toner image which had color tones faithful to those of the original image and was excellent in a gradational characteristic.

EXAMPLE 10

| | |
|---|---|
| Polyester resin obtained by condensation of propoxidized bisphenol and fumaric acid | 100 wt. parts |
| Phthalocyanine pigment | 5 wt. parts |
| Chromium complex of di-tertialy-butylsalicylic acid | 4 wt. parts |

by using a hammer mill and then finely pulverized by means of a pulverizer based on an air-jet system. The fine pulverized product was classified to obtain negatively chargeable cyan-colored resin particles of 2–10 microns having a volume-average particle size of 7.8 microns.

The thus obtained particles had an apparent viscosity of $6.00\times10^5$ poise (at 90° C.) and $1.1\times10^4$ poise (at 100° C.). 100 wt. parts of the above-mentioned colored resin particles was mixed with 0.3 wt. part of alumina fine powder (charge amount: −4 μc/g) having a BET specific surface area of 100 $m^2/g$, and 0.5 wt. part of silica fine powder (charge amount: −80 μ/g) having a BET specific surface area of 250 $m^2/g$ which had been treated with a hydrophobicity-imparting agent (hexamethyldisilazane), to obtain a cyan toner.

6 wt. parts of the cyan toner was mixed with 94 wt. parts of a Cu-Zn-Fe-basis ferrite particles (the same as in Example 1) surface-coated with a styreneacrylic acid-2-ethylhexyl methacrylate copolymer (copolymerization wt. ratio=45:20:35, weight-average molecular weight (mw)=5500, number-average molecular weight (Mn)=2100), whereby a two-component developer was prepared.

The charge amount of the toner under low temperature-low humidity conditions (15° C., 10% RH) and high temperature-high humidity conditions (32.5° C., 85% RH) are shown in Table 4 appearing hereinafter.

The thus prepared developer was charged in an ordinary copying machine for plain paper (CLC-1, mfd. by Canon K.K.) and was subjected to successive copying of 30,000 sheets under normal temperature-normal humidity conditions (23° C., 60% RH), low temperature-low humidity conditions (15° C., 10% RHS and high temperature-high humidity conditions (32.5° C., 85%

RH). As a result, high-quality images having a sufficiently high image density were obtained under any of these conditions.

Comparative Example 2

A two-component developer was prepared in the same manner as in Example 10 except that 0.8 wt. part of silica fine powder having a BET specific surface area of 100 $m^2/g$ treated with dimethyldichlorosilane (triboelectric charge amount: $-130$ $\mu c/g$) was used alone as a fluidity improver.

The thus prepared developer was subjected to successive copying in the same manner as in Example 10. As a result, image density was lowered under low temperature-low humidity conditions, and the image density was further lowered along with the progress in the successive copying.

EXAMPLE 11

A two-component developer was prepared in the same manner as in Example 10 except that 0.7 wt. part of alumina fine powder having a BET specific surface area of 120 $m^2/g$ (triboelectric charge amount: $-b$ 4 $\mu c/g$) was used alone as a fluidity improver.

The thus prepared developer was subjected to successive copying in the same manner as in Example 10. As a result, good images were obtained in the initial stage but toner scattering in the successive copying was marked as compared that in Example 10, and fog occurred in the resultant image. Further, when the same copying was conducted while decreasing the toner concentration to 4%, the evaluation of toner scattering and fog was poorer than those in Example 10. Further, under high temperature-high humidity (H/H) conditions, the developer of Example 11 provided a high image density but change in its performance with respect to environmental condition change was larger than that of Example 10.

Comparative Example 2

A two-component developer was prepared in the same manner as in Example 10 except that 0.5 wt. part of silica fine powder having a BET specific surface area of 250 $m^2/g$ treated with hexamethyldisilazane (triboelectric charge amount: $-150$ $\mu c/g$) and 0.3 wt. part of alumina fine powder having a BET specific surface area of 200 $m^2/g$ (triboelectric charge amount: $-4$ $\mu c/g$) were used as a fluidity improver in combination.

The thus prepared developer was subjected to successive copying in the same manner as in Example 10. As a result, the mixability with the magnetic particles was poor and there occurred toner particles insufficiently charged triboelectrically, and fog became noticeable after about 500 sheets of copying.

EXAMPLE 12

| | |
|---|---|
| Polyester resin obtained by condensation of propoxidized bisphenol and terephthalic acid | 100 wt. parts |
| Rhodamine pigment | 3 wt. parts |
| Chromium complex of di-tertialy-butylsalicylic acid | 4 wt. parts |
| Low-molecular weight polypropylene | 2 wt. parts |

By using the above ingredients, red powder having a volume-average particle size of 6.5 microns was prepared in the same manner as in Example 10.

100 wt. parts of the above-mentioned colored resin particles was mixed with 0.4 wt. part of alumina fine powder (triboelectric charge amount: $-3$ $\mu c/g$) having a BET specific surface area of 95 $m^2/g$, and 0.4 wt. part of silica fine powder (triboelectric charge amount: $-80$ $\mu c/g$) having a BET specific surface area of 150 $m^2/g$ which had been treated with a hydrophobicity-imparting agent by external addition, to obtain a magenta toner.

6 wt. parts of the above toner was mixed with 94 wt. parts of ferrite carrier surface-coated with a styrene-acrylic acid ester copolymer (copolymerization wt. ratio =50:50, weight-average molecular weight (mw) =6000, number-average molecular weight (Mn) =3000), whereby a two-component developer was prepared.

The thus prepared developer was charged in commercially available copying machine for plain paper (NP-COLOR T, mfd. by Canon K.K.) and was subjected to successive copying of 10,000 sheets under the same conditions as in Example 10. As a result, high-quality images having a sufficiently high image density were obtained under any of these conditions.

EXAMPLE 13

A two-component developer was prepared in the same manner as in Example 10 except that silica fine powder having a BET specific surface area of 250 $m^2/g$ treated with hexamethyldisilazane (triboelectric charge amount: $-80$ $\mu c/g$) and titanium oxide fine powder having a BET specific surface area of 40 $m^2/g$ (triboelectric charge amount: $+5$ $\mu c/g$) treated with octyltrimethoxysilane were used as a fluidity improver.

The thus prepared developer was subjected to successive copying in the same manner as in Example 10. As a result, high-quality images having a sufficiently high image density were obtained under any of the above-mentioned conditions.

EXAMPLE 14

A yellow tone having a volume-average particle size of 7.5 microns was prepared in the same manner as in Example 10 except that 3.5 parts of C.I. Pigment Yellow 17 was used instead of the phthalocyanine pigment.

A magenta toner having a volume-average particle size of 7.6 microns was prepared in the same manner as in Example 10 except that 0.9 parts of C.I. Solvent Red 4a and 1.0 part of C.I. Solvent 52 were used instead of the phthalocyanine pigment.

Further, a black toner having a volume-average particle size of 7.5 microns was prepared in the same manner as in Example 10 except that 1.2 part of C.I. Pigment Yellow 17, 2.8 parts of C.I. Pigment Red 5 and 1.5 parts of C.I. Pigment Blue 15 were used instead of the phthalocyanine pigment.

The above-mentioned yellow, magenta and black toners, and the cyan toner obtained in Example 10 were respectively mixed with the magnetic particles used in Example 10 to prepare developers of respective colors.

When these toners were applied to a modification of a full-color laser copying machine (PIXEL, mfd. by Canon K.K.) and subjected to image formation, good full-color images were obtained.

COMPARATIVE EXAMPLE 4

A two-component developer was prepared in the same manner as in Example 13 except that of silica fine powder treated with hexamethyldisilazane (triboelectric charge amount: −150 μc/g) alone was used as a fluidity improver and a styrene-acrylic copolymer resin (Mw=23,000, Mn =7,000) was used as a binder resin.

When this toner was applied to a full-color laser copying machine (PIXEL, mfd. by Canon K.K.) to obtain unfixed toner images which were then fixed by using a fixing device. However, the color toner of Comparative Example 4 was poor in environmental stability, fixability and color reproducibility, as compared with the color toner of Example 13 comprising a sharply meltable polyester resin as a binder resin.

TABLE 4

| | Charge amount (μC/g) | | |
|---|---|---|---|
| | Low-temp./ low humidity (L) | High temp./ high humidity (H) | Environmental difference (\|L-H\|) |
| Example 10 | −39 | −23 | 16 |
| 11 | −15 | −8 | 7 |
| 12 | −33 | −22 | 11 |
| 13 | −44 | −25 | 19 |
| 14 (cyan toner) | −40 | −22 | 18 |
| Comparative Example 2 | −59 | −25 | 34 |
| 3 | −38 | −19 | 19 |

As described hereinabove, according to the present invention, there is provided a developer which is capable of providing a high-quality image having good color reproducibility and capable of showing good environmental characteristic even when environmental conditions are changed.

EXAMPLE 15

| | |
|---|---|
| Polyester resin obtained by condensation of propoxidized bisphenol and fumaric acid | 100 wt. parts |
| Phthalocyanine pigment | 5 wt. parts |
| Chromium complex of di-tertialy-butylsalicylic acid | 4 wt. parts |

A mixture containing the above ingredients in the prescribed amounts was sufficient pre-mixed by means of a Henschel mixer and then melt-kneaded on a three-roll mill at least two times. After cooling, the kneaded product was coarsely crushed to about 1–2 mm by using a hammer mill and then finely pulverized by means of a pulverizer based on an air-jet system. The fine pulverized product was classified to obtain colored resin particles of 2–10 microns having a volume-average particle size of 7.8 microns.

The thus obtained resin particles had an apparent viscosity of $6.00\times10^5$ poise (at 90° C.) and $1.1\times10^4$ poise (at 100° C.).

100 wt. parts of the above-mentioned colored resin particles was mixed with 0.6 wt. part of alumina fine powder (charge amount: +1.7 μc/g with respect to magnetic particles described below) having a BET specific surface area of 100 $m^2/g$, and 0.4 wt. part silica fine powder (charge amount: −85 μc/g) by external addition to obtain a cyan toner.

6 wt. parts of the cyan toner was mixed with 94 wt. parts of a Cu-Zn-Fe-basis ferrite carrier surface-coated with a styrene-methyl acrylic acid-2-ethylhexyl methacrylate copolymer, whereby a two-component developer was prepared.

The above-mentioned colored resin particles were triboelectrically charged to have a charge amount of −32 μc/g when charged by using the above ferrite particles.

Figure 3:
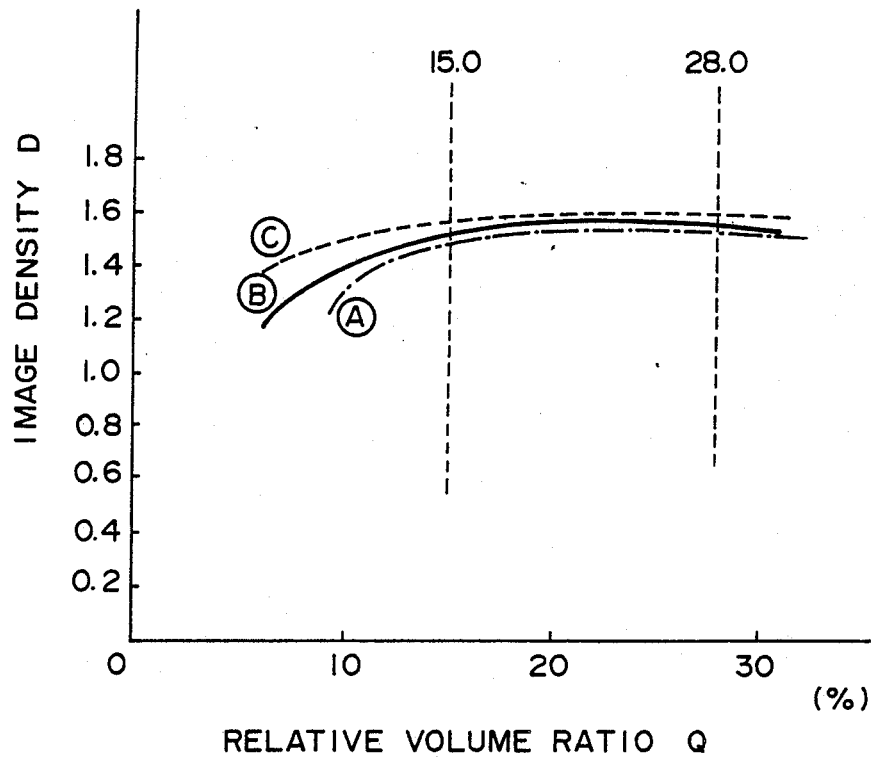
FIGS. 3 and 5 are graphs each showing relationships between relative volume ratio and image density in the present invention.

FIG. 3 is a graph showing a relationship between the relative volumetric ratio (Q) and the image density when the above-mentioned cyan developer was used. The electric field intensity used herein was F =2.56 (V/micron).

In FIG. 3, "A" represents a relationship under a temperature of 20° C. and a relative humidity of 10% (N/L); "B" a relationship under a temperature of 23° C. and a relative humidity of 60% (N/N); and "C" a relationship under a temperature of 30° C. and a relative humidity of 80% (H/H). As will be understood from the curves of this figure, if Q was smaller than 15%, the image density varies greatly with even a small change of the relative volumetric ratio Q, particularly under the low humidity condition. In addition, the thickness of the developer layer formed on the surface of the sleeve 2 became non-uniform as a whole, and particularly in the half tone area, the non-uniform image results. If the relative volumetric ratio Q exceeded 28.0%, the degree of coverage of the sleeve surface by the magnetic brush of the carrier particles increased, resulting in foggy background and a decrease in the image density attributable to the obstruction to the developer movement between the sleeve 22 and the photosensitive member 1 under the alternating electric field.

The above prepared developer was charged in a developing device as shown in FIG. 1, wherein the clearance between a developing sleeve 22 and a cut blade 24 was set to 650 microns. The developing device was assembled in a copying machine (trade name: PC-10, mfd. by Canon K.K.) which had ben modified so as to effect reversal development.

In the copying machine, the clearance between a photosensitive drum 1 (outside diameter: 60 mm) comprising an organic photoconductor (OPC), and the sleeve 22 (outside diameter: 20 mm) was set to 350 microns, and the peripheral speed ratio $\sigma$ between the photosensitive drum 1 and the developing sleeve 22 was set to 1.5. The photosensitive drum 1 was charged to have a latent image potential of −600 V and was imagewise exposed to light to have an exposure latent image potential of −250 V. In the development, there was used a bias voltage obtained by an AC voltage having a frequency of 1800 Hz and a peak-to-peak value of 1400 V on a DC voltage of −490 V. In such development, the relative volume ratio Q was 25.7 (%), and the maximum electric field intensity F was 2.69 (V/micron).

By using the above-mentioned combination, there were obtained very good images having an initial image density of 1.54 without fog or attachment of magnetic particles.

Further, when successive copying of 3,000 sheets was conducted under normal temperature-normal humidity (23° C., 60% RH) conditions, very good images having an image density of 1.45–1.60 were obtained. When a color transparency for OHP (overhead projector) was prepared by using the above-mentioned developer, and the resultant projection image was observed, a clear image without a shadow due to attachment of magnetic particles was obtained.

Further, when successive copying of 3,000 sheets was also conducted under low temperature-low humidity (20° C., 10% RH) conditions, good images having an image density of 1.40–1.55 were obtained. When successive copying was conducted in the same manner under high temperature-high humidity (30° C., 80% RH), good images having an image density of 1.48–1.65 were obtained and no toner scattering was observed.

EXAMPLE 16

A two-component developer was prepared in the same manner as in Example 15 except that titanium oxide fine powder having a BET specific surface area of 50 $m^2/g$ (triboelectric charge amount: $-3.3$ $\mu c/g$) was used as a fluidity improver, instead of the alumina.

The thus prepared developer was subjected to successive copying in the same manner as in Example 15. As a result, good color images were obtained.

COMPARATIVE EXAMPLE 5

A two-component developer was prepared in the same manner as in Example 15 except that hydrophobic fine powder having a BET specific surface area of 200 $m^2/g$ treated with dimethyldichlorosilane (triboelectric charge amount: $-140$ $\mu c/g$ with respect to magnetic particles used in this instance) was used as a fluidity improver.

The thus prepared developer was subjected to successive copying in the same manner as in Example 15. As a result, image density was lowered and image unevenness occurred under low temperature-low humidity conditions.

EXAMPLE 17

A yellow tone having a volume-average particle size of 7.5 microns was prepared in the same manner as in Example 15 except that 3.5 parts of C.I. Pigmen Yellow 17 was used instead of the phthalocyanine pigment.

A magenta toner having a volume-average particle size of 7.6 microns was prepared in the same manner as in Example 15 except that 0.9 parts of C.I. Solvent Red 4a and 1.0 part of C.I. Solvent 52 were used instead of the phthalocyanine pigment.

Further, a black toner having a volume-average particle size of 7.5 microns was prepared in the same manner as in Example 15 except that 1.2 parts of C.I. Pigment Yellow 17, 2.8 parts of C.I. Pigment Red 5 and 1.5 parts of C.I. Pigment Blue 15 were used instead of the phthalocyanine pigment.

The above-mentioned yellow, magenta and black toners, and the cyan toner obtained in Example 15 were respectively mixed with the magnetic particles used in Example 15 to prepare developers of respective colors.

These toners were applied to a modification of a full-color laser copying machine (PIXEL, mfd. by Canon K.K.).

In this case, the photosensitive drum was charged to have a latent image potential of $-550$ V and was imagewise exposed to light to have an exposure latent image potential of $-165$ V. In the development, there was used a bias voltage obtained by an AC voltage having a frequency of 2000 Hz and a peak-to-peak value of 1800 V on a DC voltage of $-440$ V. In such development, the peripheral ratio $\sigma$ was 1.75, the relative volume ratio Q was $(23\pm3)$ (%), and the maximum electric field intensity F was 2.44 (V/micron).

Further, the respective colored resin particles had a charge amount as follows:

Yellow particles: $-37$ $\mu c/g$

Magenta particles: $-30$ $\mu c/g$

Black particles: $-35$ $\mu c/g$

By using the above-mentioned conditions, there were obtained very good full-color images. When a color transparency for OHP (overhead projector) was prepared by using the above-mentioned developer, and the resultant projection image was observed, a clear image without a shadow due to attachment of magnetic particles was obtained.

EXAMPLE 18

A two-component developer was prepared and the developer was subjected to image formation in the same manner as in Example 15 except that magnetic particles containing 6% of particles of 35 microns or smaller were used. As a result, under high temperature-high humidity conditions, cleaning failure occurred after about 2,300 sheets of copying.

EXAMPLE 19

A two-component developer was prepared and the developer was subjected to image formation in the same manner as in Example 15 except that magnetic particles containing 0.8% of particles of 35 microns or smaller were used. As a result, under high temperature-high humidity conditions, cleaning failure due to toner sticking occurred after about 1,800 sheets of copying.

In the present invention, because a specific developer as described above is used, triboelectric chargeability is stable and the attachment of magnetic particles may suitably be prevented. Further, in the present invention, there may be obtained a high-quality color image free of fog, even under high temperature-high humidity, and low temperature-low humidity conditions.

EXAMPLE 20

100 wt. parts of the same cyan-colored resin particles obtained in Example 15 was mixed with 0.6 wt. part of silica fine powder (primary particle size measured by electron microscope observation: 0.1.–0.2 micron, charge amount (A) $=-50$ $\mu c/g$, charge amount (B) $=-30$ $\mu c/g$, $|B/A|=0.6$) and 0.4 wt. parts of alumina (charge amount: $+1.7$ $\mu c/g$) by external addition to prepare a cyan toner.

The color toner in an amount of 6 wt. parts was mixed with a Cu-Zn-Fe-basis ferrite carrier (weight average particle size: 55 microns, proportion of particles of 35 microns or smaller: 2.2%, proportion of particles of 35–40 microns: 80%, proportion of particles of 74 microns or larger; 0.8%) coated with about 0.5 wt. % of a 50:50 (wt.)-mixture of vinylidene fluoride-tetrafluoroethylene copolymer and styrene methyl methacrylate-2-ethylhexyl methacrylate copolymer so as to provide a total amount of 100 wt. parts, whereby a two-component developer was prepared.

Figure 5:
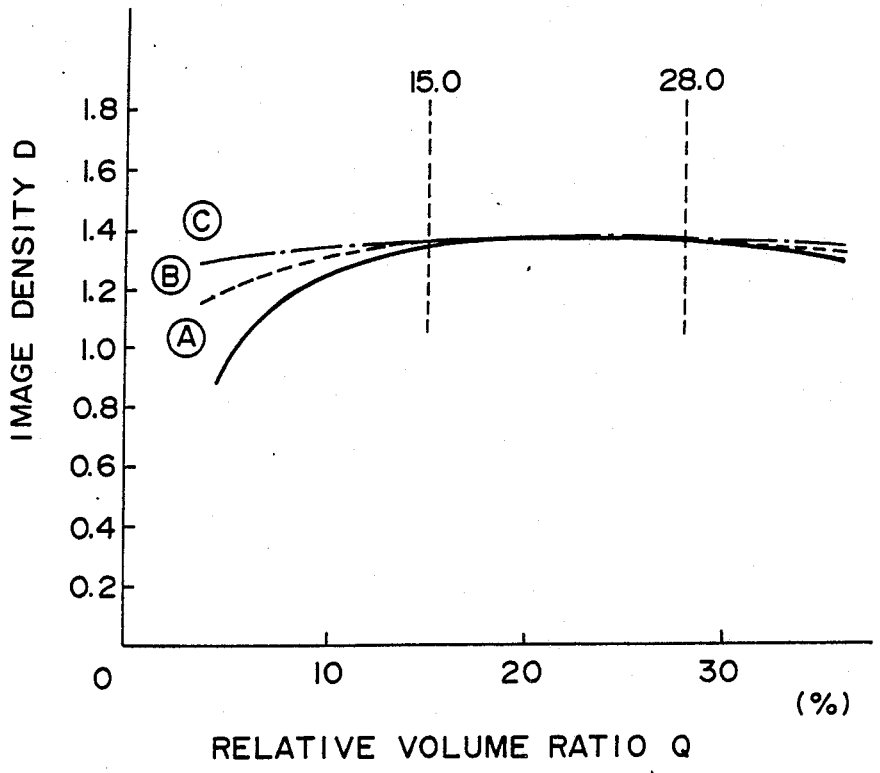

FIG. 5 is a graph showing a relationship between the relative volumetric ratio (Q) and the image density when the above-mentioned cyan developer was used. The electric field intensity used herein was F $=2.56$ (V/micron).

In FIG. 5, "A" represents a relationship under a temperature of 20° C. and a relative humidity of 10% (N/L); "B" a relationship under a temperature of 23° C. and a relative humidity of 60% (N/N); and "C" a relationship under a temperature of 30° C. and a relative humidity of 80% (H/H). As will be understood from the curves of this figure, if Q was smaller than 15%, the image density varies greatly with even a small change of the relative volumetric ratio Q, particularly under the low humidity condition. In addition, the thickness of the developer layer formed on the surface of the sleeve 2 became non-uniform as a whole, and particularly in the half tone area, the non-uniform image results. If the relative volumetric ratio Q exceeded 28.0%, the degree of coverage of the sleeve surface by the magnetic brush of the carrier particles increased, resulting in foggy background and a decrease in the image density attributable to the obstruction to the developer movement between the sleeve 22 and the photosensitive member 1 under the alternating electric field.

The thus prepared developer was charged in a developing device as shown in FIG. 1, wherein the clearance between a developing sleeve 22 and a cut blade 24 was set to 60 microns. The developing device was assembled in a color laser copying machine using a digital developing system and a reversal developing system (trade name: PIXEL, mfd. by Canon K.K.) which had been modified so as to effect reversal development.

In the copying machine, the clearance between a photosensitive drum 1 (outside diameter: 60 mm) comprising an organic photoconductor (OPC), and the sleeve 22 (outside diameter: 20 mm) was set to 350 microns, and the peripheral speed ratio $\sigma$ between the photosensitive drum 1 and the developing sleeve 22 was set to 1.5. The photosensitive drum 1 was charged to have a latent image potential of −600 V and was imagewise exposed to light to have an exposure latent image potential of −250 V. In the development, there was used a bias voltage obtained by an AC voltage having a frequency of 1800 Hz and a peak-to-peak value of 1400 V on a DC voltage of −490 V. In such development, the relative volume ratio Q was 25.7 (%), and the maximum electric field intensity F was 2.69 (V/micron).

By using the above-mentioned combination, there were obtained very good images having an initial image density of 1.36 without fog or attachment of magnetic particles.

Further, when successive copying was conducted, very good images having an image density of 1.3–1.45 were obtained. When a color transparency for OHP (overhead projector) was prepared by using the above-mentioned developer, and the resultant projection image was observed, a clear image without a shadow due to attachment of magnetic particles was obtained.

Further, when successive copying was also conducted under low temperature-low humidity (20° C., 10% RH) conditions, and under high temperature-high humidity (30° C., 80% RH), good images were obtained from the initial stage.

COMPARATIVE EXAMPLE 6

A two-component developer was prepared and the resultant developer was subjected to image formation in the same manner as in Example 20 except that silica fine powder treated with dimethyl dichlorosilane (charge amount (A) = −119 μc/g, charge amount (B) = −285 μc/g, |B/A| = 2.4) was used instead of that treated with hexamethylsilazane.

As a result, the image density was lowered and image unevenness occurred, particularly in low temperature-low humidity conditions.

Further, a color transparency for OHP was prepared by using the above-mentioned developer, and the resultant projection image was observed, black spots based on carrier attachment were found.

COMPARATIVE EXAMPLE 7

A two-component developer was prepared and the resultant developer was subjected to image formation in the same manner as in Example 20 except that silica fine powder treated with a silicone oil (charge amount (A) = −160 μc/g, charge amount (B) = −180 μc/g, |B/A| = 1.3) was used instead of that treated with hexamethylsilazane.

As a result, image defects based on carrier attachment were observed at the time of 1,000 sheets under low temperature-low humidity conditions.

What is claimed is:

1. An image forming method, comprising:

providing a developer comprising at least colored resin particles, a fluidity improver and magnetic particles wherein the colored resin particles have a volume-average particle size of 4–10 microns and a volume-basis particle size distribution such that they contain 1% by volume or below of particles having a particle size of 20.2 microns or larger, and the fluidity improver has a triboelectric charging characteristic such that it provides an absolute value of triboelectric charge amount of 100 μc/g or smaller with respect to the magnetic particles;

supplying the developer to a surface of a developer-carrying member disposed opposite to a latent image-bearing member having thereon an electrostatic latent image;

carrying the developer on the surface of the developer-carrying member; and developing the electrostatic latent image on the latent image-bearing member with the developer in a developing zone where the latent image-bearing member is disposed opposite to the developer-carrying member to form a toner image;

wherein an alternating electric field comprising an AC component and a DC component is imparted to the developing zone; the maximum electric field strength F (V/micron) formed in the minimum clearance G (micron) between the surface of the developer-carrying member and the surface of the electrostatic latent image-bearing member satisfies the following relationships:

$$1.5 \leqq F \leqq 3.5, \text{ and}$$

$$F = (|V_{ppMax}/2| + |V_{DC} - V_L|/G,$$

wherein $V_L$ (V) denotes the potential of the electrostatic image portion (i.e., portion supplied with image exposure), $V_{DC}$ (V) denotes the voltage of the DC component of the alternating electric field having the same polarity as that of $V_L$, and VppMax (V) denotes the voltage at the maximum electric field application point which is at the opposite side of the image portion potential $V_L$, with respect to the $V_{DC}$; the frequency $\nu$ (KHz) of the alternating electric field satisfies $0.8 \leqq \nu \leqq 3.0$; the relative volumetric ratio Q (%) of the magnetic particles satisfies $15.0 \leqq Q \leqq 45.0$; and the ratio $\sigma$ between the peripheral speed of the developer-carrying member and that of the electrostatic image-bearing member in the developing zone satisfies $1.2 \leqq \sigma \leqq 2.5$.

2. An image forming method according to claim 1, wherein the colored resin particles have a volume-basis distribution such that they contain 1% by volume or less of particles having a particle size of 16.0 microns or above.

3. An image forming method according to claim 1, wherein the colored resin particles have been mixed with at least two species of fluidity improvers having an absolute value of triboelectric charge amount of 100 μc/g or smaller.

4. An image forming method according to claim 3, wherein the at least two species of fluidity improver comprise a first fluidity improver comprising hydrophilic inorganic oxide and a second fluidity improver comprising a hydrophobic inorganic oxide.

5. An image forming method according to claim 4, wherein the second fluidity improver satisfies the following conditions:

$$0.5 \leqq |B/A| \leqq 2, \text{ and}$$

$$15 \leqq |A| \leqq 100,$$

wherein A denotes a triboelectric charge amount of the second fluidity improver when mixed with said magnetic particles reciprocally 60 times, and B denotes a triboelectric charge amount of the second fluidity improver when mixed with said magnetic particles reciprocally 30,000 times.

6. An image forming method according to claim 4, wherein the developer comprises the magnetic particles, the colored resin particles, b wt. % (based on the colored resin particles) of a first fluidity improver comprising a hydrophilic inorganic oxide B, and a wt. % (based on the colored resin particles) of a second fluidity improver comprising a hydrophobic inorganic oxide A; said hydrophilic inorganic oxide B having an absolute value of triboelectric charge amount of 20 μc/g or below, and a BET specific surface area ($S_B$) of 30–200 $m^2/g$; said hydrophobic inorganic oxide A having a triboelectric charge amount of 50–100 μc/g and a BET specific surface area ($S_A$) of 80–300 $m^2/g$; said specific surface areas $S_A$ and $S_B$, and the contents a and b satisfying the following conditions:

$$S_A \geqq S_B,$$

$$a \geqq b, \text{ and}$$

$$0.3 \leqq (a+b) \leqq 1.5.$$

7. An image forming method according to claim 6, wherein the first fluidity improver comprises alumina or titanium oxide, and the second fluidity improver comprises hydrophobic silica.

8. An image forming method according to claim 1, wherein the magnetic particles having a weight-average particle size of 35–65 microns, and a weight-basis distribution such that they contain 1–5 wt. % of magnetic particles having a particle size of below 35 microns, 5–20 wt. % of magnetic particles having a particle size of 35–43 microns, and 1 wt. % or less of magnetic particles having a particle size of 75 microns or above.

9. An image forming method according to claim 1, wherein the colored resin particles have a number-basis distribution such that they contain 15–40% by number of particles having a particle size of 5 microns or below; a volume-basis distribution such that they contain 0.1–5.0% by volume of particles having a particle size of 12.7–16.0 microns and 1.0% by volume or less of particles having a particle size of 16 microns or above; and particles having a particle size of 6.35–10.1 microns satisfy the following formula in the particle size distribution of the colored resin particles:

$$9 \leqq (V \times dv)/N \leqq 14,$$

wherein V denotes the percentage by volume of the particles having a particle size of 6.35–10.1 microns in the volume-basis distribution, N denotes the percentage by number of the particles having a particle size of 6.35–10.1 microns in the number-basis distribution, and $\overline{dv}$ denotes the volume-average particle size of the colored resin particles.

10. An image forming method according to claim 9, wherein mixture powder (toner) comprising the colored resin particles and the fluidity improver has an agglomeration degree of 25% or less, an apparent density of 0.2–0.8 $g/cm^3$, an apparent viscosity of $10^4$ to $5 \times 10^5$ poise at 100° C. and $5 \times 10^4$ to $5 \times 10^6$ poise at 90° C., and a heat-absorption peak according to DSC of 58°–72° C.

11. An image forming method according to claim 1, wherein the colored resin particles are contained in the developer in an amount of 2.0–12 wt. %.

12. An image forming method according to claim 1, wherein the magnetic particles comprise ferrite particles coated with a resin which have a resistivity of $10^7$ ohm.cm or more.

13. An image forming method according to claim 12, wherein the magnetic particles have a resistivity of $10^8$ ohm.cm or more.

14. An image forming method according to claim 13, wherein the magnetic particles have a maximum magnetization of 55–75 emu/g.

15. An image forming method according to claim 1, wherein the maximum electric field strength is 1.5–3.0 (V/micron).

16. An image forming method according to claim 1, wherein the developer in the developing zone has a relative volumetric ratio (Q) represented by the following formula satisfying $15.0 \leqq Q \leqq 28.0$, and the alternating electric field has a frequency (ν (KHz)) satisfying $0.8 \leqq || \leqq 2.2$;

$$Q\ (\%) = M/h \times 1/\rho \times C/(T+C) \times \sigma \times 100,$$

wherein M ($g/cm^2$) denotes the amount of the developer per unit area of the surface of the developer-carrying member, h (cm) denotes the height of the developing zone space, ρ ($g/cm^3$) denotes the true density of the magnetic particles, C denotes the weight of the magnetic particles, T denotes the weight of the mixture of colored resin particles and the fluidity improver, and σ denotes the relative speed ratio between the developer-carrying member and the latent image-bearing member.

17. A developer for developing electrostatic latent images, comprising at least magnetic particles, colored resin particles and a fluidity improver; said magnetic particles having a weight-average particle size of 35–65 microns, and a weight-basis distribution such that they contain 1–20 wt. % of magnetic particles having a particle size of not less than 26 microns and below 35 microns, 5–20 wt. % of magnetic particles having a particle size of 35–43 microns, and 2 wt. % or less of magnetic particles having a particle size of 74 microns or above; said colored resin particles having a volume-average particle size of 4–10 microns and a volume-basis distribution such that they contain 1% or less of particles having a particle size of 20.2 microns or above; said fluidity improver having a charging characteristic satisfying the following conditions:

$$0.5 \leqq |B/A| \leqq 2, \text{ and}$$

$15 \leqq A \leqq 100$, wherein A denotes the triboelectric charge amount of the fluidity improver when mixed with said magnetic particles reciprocally 60 times, and B denotes that of the fluidity improver when mixed with said magnetic particles reciprocally 30,000 times.

18. A developer according to claim 17, wherein the colored resin particles have a volume-basis distribution such that they contain 1% by volume or less of particles having a particle size of 16.0 microns or above.

19. A developer according to claim 18, wherein the colored resin particles have further been mixed with a fluidity improver having an absolute triboelectric charge amount of 100 μc/g or smaller.

20. A developer according to claim 19, wherein the fluidity improver comprise a first fluidity improver comprising a hydrophilic inorganic oxide and a second fluidity improver comprising a hydrophobic inorganic oxide.

21. A developer according to claim 20, wherein the second fluidity improver satisfies the following conditions:

$0.5 \leqq |B/A| \leqq 2$, and $15 \leqq |A| \leqq 100$, wherein A denotes a triboelectric charge amount of the second fluidity improver when mixed with said magnetic particles reciprocally 60 times, and B denotes a triboelectric charge amount of the second fluidity improver when mixed wit said magnetic particles reciprocally 30,000 times.

22. A developer according to claim 20, which comprises the magnetic particles, the colored resin particles, b wt. % (based on the colored resin particles) of a first fluidity improver comprising a hydrophilic inorganic oxide B, and a wt. % (based on the colored resin particles) of a second fluidity improver comprising a hydrophobic inorganic oxide A; said hydrophilic inorganic oxide B having an absolute value of triboelectric charge amount of 20 μc/g or below, and a BET specific surface area ($S_B$) of 30–200 $m^2/g$; said hydrophobic inorganic oxide A having a triboelectric charge amount of 50–100 μc/g and a BET specific surface area ($S_A$) of 80–300 $m^2/g$; said specific surface areas $S_A$ and $S_B$, and the contents a and b satisfying the following conditions:

$S_A \geqq S_B$, $a \geqq b$, and $0.3 \leqq (a+b) \leqq 1.5$.

23. A developer according to claim 22, wherein the first fluidity improver comprises alumina or titanium oxide, and the second fluidity improver comprises hydrophobic silica.

24. A developer according to claim 17, wherein the magnetic particles have a weight-basis distribution such that they contain 1 wt. % or less of magnetic particles having a particle size of 75 microns or above.

25. A developer according to claim 17, wherein the colored resin particles have a number-basis distribution such that they contain 15–40% by number of particles having a particle size of 5 microns or below; a volume-basis distribution such that they contain 0.1–5.0% by volume of particles having a particle size of 12.7–16.0 microns and 1.0% by volume or less of particles having a particle size of above 16 microns; and particles having a particle size of 6.35–10.1 microns satisfy the following formula in the particle size distribution of the colored resin particles:

$9 \leqq (V \times dv)/N \leqq 14$, wherein V denotes the percentage by volume of the particles having a particle size of 6.35–10.1 microns in the volume-basis distribution, N denotes the percentage by number of the particles having a particle size of 6.35–10.1 microns in the number-basis distribution, and $\overline{dv}$ denotes the volume-average particle size of the colored resin particles.

26. A developer according to claim 25, wherein mixture powder (toner) comprising the colored resin particles and the fluidity improver has an agglomeration degree of 25% or less, an apparent density of 0.2–0.8 $g/cm^3$, an apparent viscosity of $10^4$ to $5 \times 10^5$ poise at 100° C. and $5 \times 10^4$ to $5 \times 10^6$ poise at 90° C., and a heat-absorption peak according to DSC of 58°–72° C.

27. A developer according to claim 17, which contains the colored resin particles in an amount of 2.0–12 wt. %.

28. A developer according to claim 17, wherein the magnetic particles comprise ferrite particles coated with a resin which have a resistivity of $10^7$ ohm.cm or more.

29. A developer according to claim 28, wherein the magnetic particles have a resistivity of $10^8$ ohm.cm or more.

30. A developer according to claim 17, wherein the magnetic particles have a maximum magnetization of 55–75 emu/g.

31. A toner for developing electrostatic latent images comprising: colored resin particles having a volume-average particle size of 4–10 microns, a wt. % (based on the colored resin particles) of a hydrophobic inorganic oxide A, and b wt. % (based on the colored resin particles) of a hydrophilic inorganic compound B: said hydrophobic inorganic oxide A having an absolute value of triboelectric charge amount of 50 μc/g or larger and a BET specific surface area ($S_A$) of 80–300 $m^2/g$; said hydrophilic inorganic compound B having an absolute value of triboelectric charge amount of 20 μc/g or below, and a BET specific surface area ($S_B$) of 30–200 $m^2/g$; said specific surface areas $S_A$ and $S_B$, and the contents a and b satisfying the following conditions:

$S_A \geqq S_B$, $a \geqq b$, and $0.3 \leqq (a+b) \leqq 1.5$.

32. A toner according to claim 31, wherein the colored resin particles have a number-basis distribution such that they contain 15–40% by number of particles having a particle size of 5 microns or below; a volume-basis distribution such that they contain 0.1–5.0% by volume of particles having a particle size of 12.7–16.0 microns and 1.0% by volume or less of particles having a particle size of above 16 microns; and particles having a particle size of 6.35–10.1 microns satisfy the following formula in the particle size distribution of the colored resin particles:

$9 \leqq (V \times dv)/N \leqq 14$, wherein V denotes the percentage by volume of the particles having a particle size of 6.35–10.1 microns in the volume-basis distribution, N denotes the percentage by number of the particles having a particle size of 6.35–10.1 microns in the number-basis distribution, and $\overline{dv}$ denotes the volume-average particle size of the colored resin particles.

33. A toner according to claim 32, wherein the hydrophobic inorganic oxide A comprises hydrophobic silica, and the hydrophilic inorganic oxide B comprises alumina or titanium oxide.

34. A toner according to claim 31, wherein the colored resin particles are non-magnetic and have a negative chargeability, and the inorganic oxide A has a negative chargeability of $-50$ to $-100$ $\mu c/g$.

35. A toner according to claim 31, which comprises mixture powder comprising the colored resin particles and the fluidity improver has an agglomeration degree of 25% or less, an apparent density of 0.2–0.8 g/cm$^3$, an apparent viscosity of $10^4$ to $5\times10^5$ poise at 100° C. and $5\times10^4$ to $5\times10^6$ poise at 90° C., and a heat-absorption peak according to DSC of 58°–72° C.

36. A toner according to claim 31, wherein the colored resin particles comprises a polyester resin, a dye or pigment, and a charge control agent.

* * * * *

UNITED STATES PATENT AND TRADEMARK OFFICE

CERTIFICATE OF CORRECTION

PATENT NO. : 4,904,558

DATED : February 27, 1990

INVENTOR(S) : Takayuki Nagatsuka et al.

It is certified that error appears in the above-identified patent and that said Letters Patent is hereby corrected as shown below:

[54] TITLE: Title Page:
Item [54] and in column 1, line 2,
"MAGNETIC" should read --TONER--.

COLUMN 1:

Line 1, "MAGNETIC" should read --TONER--.

Line 54, "become" should read --becomes--.

COLUMN 2:

Line 39, "carrier)" should read --(Carrier)--.

COLUMN 3:

Line 21, "are" should read deleted.

Line 55, "abovemen-" should read -- above-men- --.

COLUMN 4:

Line 53, "highquality" should read --high-quality--.

UNITED STATES PATENT AND TRADEMARK OFFICE

CERTIFICATE OF CORRECTION

PATENT NO. : 4,904,558

DATED : February 27, 1990

INVENTOR(S) : Takayuki Nagatsuka et al.

It is certified that error appears in the above-identified patent and that said Letters Patent is hereby corrected as shown below:

COLUMN 6:

Line 46, "$SA \geqq S_B$," should read --$S_A \geqq S_B$,--.

COLUMN 7:

Line 18, "metal" should read --metals--.

COLUMN 8:

Line 2, "tion the" should read --tion, the--.

COLUMN 9:

Line 68, "tion," should read --tion--.

COLUMN 10:

Line 4, "0.1-5.0" should read --0.1-5.0%--.

Line 12, "$9 \leqq (V \times \overline{dv})/N \leqq 14$," should read --$9 \leqq (V \times \overline{dv})/N \leqq 14$,--.

COLUMN 12:

Line 4, "$9 \leqq (V \times \overline{dv})/N \leqq 14$," should read --$9 \leqq (V \times \overline{dv})/N \leqq 14$,--.

UNITED STATES PATENT AND TRADEMARK OFFICE

CERTIFICATE OF CORRECTION

PATENT NO. : 4,904,558

DATED : February 27, 1990

INVENTOR(S) : Takayuki Nagatsuka et al.

It is certified that error appears in the above-identified patent and that said Letters Patent is hereby corrected as shown below:

COLUMN 13:

Line 51, "coulter" should read --Coulter--.

COLUMN 14:

Line 31, "to "toner". " should read --to as "toner".--.

Line 38, "$SA \leqq S_B$," should read --$S_A \geqq S_B$,--.

Line 46, "$a \leqq b$, and" should read --$a \geqq b$, and--.

COLUMN 15:

Line 50, "to "toner". " should read --to as "toner".--.

COLUMN 16:

Line 19, "t" should read --to--.

COLUMN 17:

Line 64, "electromagnetic" should read --electromagnet--.

COLUMN 18:

Line 37, "an toner" should read --a toner--.

UNITED STATES PATENT AND TRADEMARK OFFICE

CERTIFICATE OF CORRECTION

PATENT NO. : 4,904,558

DATED : February 27, 1990

INVENTOR(S) : Takayuki Nagatsuka et al.

It is certified that error appears in the above-identified patent and that said Letters Patent is hereby corrected as shown below:

COLUMN 18 (continued):

Line 38, "maybe," should read --may be,--.

COLUMN 19:

Line 52, "sleeve 2," should read --sleeve 22,--.

COLUMN 22:

Line 28, "true density $\sigma$ (g/cm$^3$)" should read --true density $\rho$ (g/cm$^3$)--.

Line 37, "Q = (M/h) x (1/$\sigma$) x [C/(T+C)] x $\sigma$ x 100" should read --Q = (M/h) x (1/$\rho$) x [C/(T+C)] x $\sigma$ x 100--.

COLUMN 23:

Line 1, "15.0-28.0 sufficient" should read --15.0-28.0%), sufficient--.

COLUMN 24:

Line 67, "2ethylhexyl" should read --2-ethylhexyl--.

UNITED STATES PATENT AND TRADEMARK OFFICE

CERTIFICATE OF CORRECTION

PATENT NO. : 4,904,558 Page 5 of 11

DATED : February 27, 1990

INVENTOR(S) : Takayuki Nagatsuka et al.

It is certified that error appears in the above-identified patent and that said Letters Patent is hereby corrected as shown below:

COLUMN 25:

Line 24, "cure," should read --curve,--.

Line 25, "recorded.(4)" should read --recorded. (new paragraph heading) (4).

Line 58, "Agglomerationdegree(%)" should read --Agglomeration degree (%).

Line 61, "sample weight on 100-mesh sieve/5 g) x 100 x 35 +" should read --(sample weight on 100-mesh sieve/5 g) x 100 x 3/5 + --.

COLUMN 26:

Line 45, "used" should read --use--.

Line 55, "Salts" should read --salts--.

COLUMN 27:

Line 9, "comparative" should read --Comparative--.

Line 64, "2ethylhexyl" should read --2-ethylhexyl--.

COLUMN 28:

Line 65, "wedges 68 and 68," should read --wedges 67 and 68,--.

UNITED STATES PATENT AND TRADEMARK OFFICE

CERTIFICATE OF CORRECTION

PATENT NO. : 4,904,558 Page 6 of 11

DATED : February 27, 1990

INVENTOR(S) : Takayuki Nagatsuka et al.

It is certified that error appears in the above-identified patent and that said Letters Patent is hereby corrected as shown below:

COLUMN 29:

Line 50, "Example 3" should read --EXAMPLE 3--, and be inset as a heading on line 51.

COLUMN 31:

TABLE 1, "$\frac{V\sqrt{dv}}{N}$" should read --$\frac{V/\overline{dv}}{N}$--.

COLUMN 33:

Table 3A, for Example 8, column under "Image Density 5000 sheets", "1.52" should read --1.42--.

UNITED STATES PATENT AND TRADEMARK OFFICE

CERTIFICATE OF CORRECTION

PATENT NO. : 4,904,558 Page 7 of 11

DATED : February 27, 1990

INVENTOR(S) : Takayuki Nagatsuka et al.

It is certified that error appears in the above-identified patent and that said Letters Patent is hereby corrected as shown below:

COLUMN 33 (continued):

Table 3B, lines 18-30,

TABLE 3B

| | Fog*1 (N/N) Initial | 1000 sheets | sheets | Toner scattering*2 (N/N) 5000 sheets | Gradational characteristic in highlight portion*3 |
|---|---|---|---|---|---|
| Ex. 1 | 0.5% | 0.8% | 1.1 | | |
| 2 | 0.6 | 1.0 | 1.3 | | |
| 3 | 0.6 | 0.8 | 1.2 | | |
| 4 | 0.6 | 1.0 | 1.3 | | Δ |
| 5 | 0.5 | 0.7 | 1.0 | | |
| 6 | 0.5 | 1.0 | 1.5 | Δ | |
| 7 | 0.7 | 1.0 | 2.0 | | |
| 8 | 0.5 | 1.0 | 1.6 | Δ | |
| Comp. Ex. 1 | 0.5 | 1.0 | 1.3 | Δ | x |

should read

Table 3B

| | Fog *1 (N/N) Initial | 1000 sheets | sheets | Toner scattering *2 (N/N) 5000 sheets | Gradational characteristic in highlight portion *3 |
|---|---|---|---|---|---|
| Ex. 1 | 0.5 % | 0.8 % | 1.1 | ● | ○ |
| 2 | 0.6 | 1.0 | 1.3 | ● | ○ |
| 3 | 0.6 | 0.8 | 1.2 | ● | ○ |
| 4 | 0.6 | 1.0 | 1.3 | ● | ○Δ |
| 5 | 0.5 | 0.7 | 1.0 | ● | ○ |
| 6 | 0.5 | 1.0 | 1.5 | Δ | ○ |
| 7 | 0.7 | 1.0 | 2.0 | ○ | ○ |
| 8 | 0.5 | 1.0 | 1.6 | Δ | ○ |
| Comp. Ex. 1 | 0.5 | 1.0 | 1.3 | Δ | × |

UNITED STATES PATENT AND TRADEMARK OFFICE

CERTIFICATE OF CORRECTION

PATENT NO. : 4,904,558

DATED : February 27, 1990

INVENTOR(S) : Takayuki Nagatsuka et al.

It is certified that error appears in the above-identified patent and that said Letters Patent is hereby corrected as shown below:

COLUMN 33 (continued):

Line 52, "... Very good" should read -- ⊙ ... Very good--.

COLUMN 34:

Line 34, before "by using", insert --A mixture containing the above ingredients in the prescribed amounts was sufficiently pre-mixed by means of a Henschel mixer and then melt-kneaded on a three-roll mill at least two times. After cooling, the kneaded product was coarsely crushed to about 1 - 2 mm--.

Line 67, "10% RHS" should read --10 % RH)--.

COLUMN 35:

Line 23, "-b 4" should read -- - 4 --.

Line 40, "Comparative Example 2" should read --Comparative Example 3--.

COLUMN 36:

Line 41, "yellow tone" should read --yellow toner--.

UNITED STATES PATENT AND TRADEMARK OFFICE

CERTIFICATE OF CORRECTION

PATENT NO. : 4,904,558 Page 9 of 11

DATED : February 27, 1990

INVENTOR(S) : Takayuki Nagatsuka et al.

It is certified that error appears in the above-identified patent and that said Letters Patent is hereby corrected as shown below:

COLUMN 38:

Line 19, "2" should read --22--.

Line 33, "ben" should read --been--.

COLUMN 39:

Line 29, "yellow tone" should read --yellow toner--.

Line 31, "C.I. Pigmen" should read --C.I. Pigment--.

COLUMN 40:

Line 67, "2" should read --22--.

COLUMN 42:

Line 42, "F = (|VppMax/2|+|$V_{DC}$-$V_L$|/G" should read --F = (|VppMax/2|+|$V_{DC}$-$V_L$|)/G--.

Line 64, Boldface should be deleted.

Line 65, Boldface should be deleted.

COLUMN 43:

Line 4, "improver" should read --improvers--.

UNITED STATES PATENT AND TRADEMARK OFFICE

CERTIFICATE OF CORRECTION

PATENT NO. : 4,904,558

DATED : February 27, 1990

INVENTOR(S) : Takayuki Nagatsuka et al.

It is certified that error appears in the above-identified patent and that said Letters Patent is hereby corrected as shown below:

COLUMN 43 (continued):

Line 67, "$9 \leqq (V \times \overline{dv})/N \leqq 14$," should read --$9 \leqq (V \times \overline{dv})/N \leqq 14$,--.

COLUMN 44:

Line 31, Boldface should be deleted.

Line 37, "$0.8 \leqq \| \leqq 2.2$;" should read --$0.8 \leqq \gamma \leqq 2.2$;--.

COLUMN 45:

Line 1, "$15 \leqq A \leqq 100$," should read --$15 \leqq |A| \leqq 100$,--.

Line 16, "comprise" should read --comprises--.

Line 32, "wit" should read --with--.

UNITED STATES PATENT AND TRADEMARK OFFICE

CERTIFICATE OF CORRECTION

PATENT NO. : 4,904,558 Page 11 of 11

DATED : February 27, 1990

INVENTOR(S) : Takayuki Nagatsuka et al.

It is certified that error appears in the above-identified patent and that said Letters Patent is hereby corrected as shown below:

COLUMN 46:

Line 6, "$9 \leqq (V \times \overline{dv})/N \leqq 14$," should read --$9 \leqq (V \times \overline{dv})/N \leqq 14$,--.

Line 68, "$9 \leqq (V \times \overline{dv})/N \leqq 14$," should read --$9 \leqq (V \times \overline{dv})/N \leqq 14$,--.

Signed and Sealed this

Fifth Day of January, 1993

*Attest:*

*Attesting Officer*

DOUGLAS B. COMER

*Acting Commissioner of Patents and Trademarks*